United States Patent [19]

Gremillet

[11] 3,944,043

[45] Mar. 16, 1976

[54] SHIFT MECHANISM IN SYLLABIC TYPEWRITERS

[76] Inventor: Jean Gremillet, 64 Avenue Felix Faure, Paris 15°, France

[22] Filed: Aug. 30, 1974

[21] Appl. No.: 502,190

Related U.S. Application Data

[60] Division of Ser. No. 259,051, June 2, 1972, which is a continuation of Ser. No. 502,188, Aug. 30, 1974.

[52] U.S. Cl. ..... 197/72; 197/7; 197/43

[51] Int. Cl.² ..... B41J 11/14; B41J 3/00

[58] Field of Search ..... 197/9, 7, 11, 43, 72

[56] References Cited

UNITED STATES PATENTS

| | | | |
|---|---|---|---|
| 594,978 | 12/1897 | Barney | 197/72 X |
| 917,248 | 4/1909 | Chambonnavd | 197/9 X |
| 1,651,739 | 12/1927 | Stickney | 197/72 X |
| 3,073,427 | 1/1963 | Gremillet | 197/7 |

*Primary Examiner*—Clyde I. Coughenour
*Assistant Examiner*—Paul T. Sewell
*Attorney, Agent, or Firm*—Robert E. Burns; Emmanuel J. Lobato; Bruce L. Adams

[57] ABSTRACT

In typewriters comprising groups of type-bars, each group having a distinct printing point, each group being supported by a particular sector and certain sectors being movable independently from the others:

a shift mechanism which allows the typist to put all the sectors together in three different positions corresponding respectively to three different character cases, the mechanism allowing also to change the case position of certain sectors, each independently from the others.

Certain sectors have a particular cushion on which rests the corresponding type bars. Other sectors have a common cushion.

The shift mechanism comprises thin sheets which are each situated between the path of movement of the type bars which belong to two succesive groups in order to constitute each a support of the corresponding cushion, to avoid collisions between type bars of these two groups and to constitute a type bar guide between these two groups.

3 Claims, 44 Drawing Figures

Part a

Part b

Part c
304
305
635
634
150
633
638
636
637
632
150
742
790
745
806
805
837
780
779
707
768
Niii-Tiv
796
795
Sv
804
785
Niii-Tiv
794
793
730
769
735
729
Niii
791
792
704
767
752
722
725
761
765
738
764
774
762
770
706
708
750
740
767
782
781
703
756
789
754
75
Sv
798
797
799
722
Tiv
TS
800
802
788
752
RS
702
787
706
803
709
784
801
783
743

Part a

Fig. 6 Part b

Part c

Part a

Fig.8 Part b

Fig.8 Part c
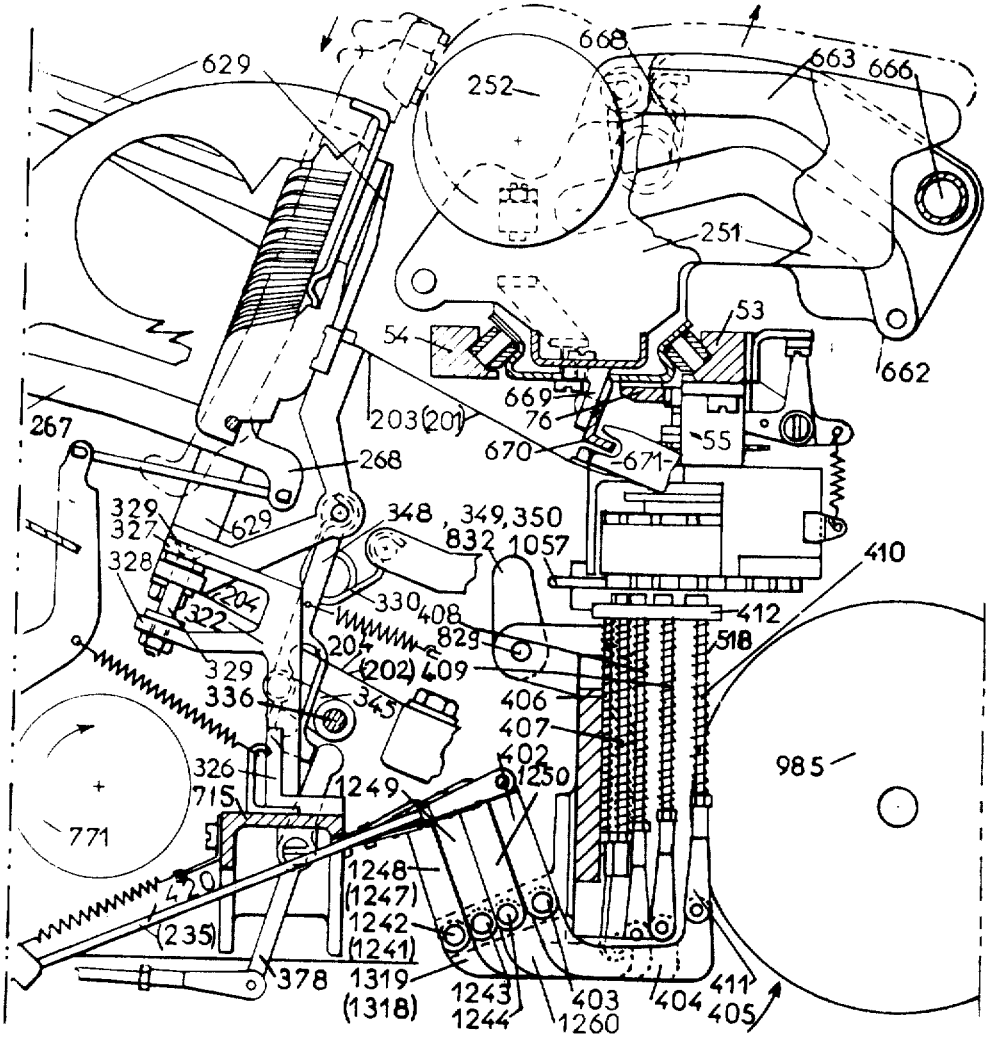

Part a

Part b 271
272
273
274
275
277
278
279
280
281
282
283
284
285
286
287
288
289
290
291
292
293
294
295
298
642
693
A
B
AA
BB 601
859
848
(849)
620
618
619
613
611 (612)
846 (847)
858
715
845
816
855
859
601
909
812
872
873
818
969
917
895
899
897
894
968
898
908
912
615 (617)
601
911
910
918
820
915
913
914
916
840
907
842
888
336
869
885
808
607
854
809
870
900
968
919
844
891
850
601
858
815
817
866
321
611
817
867
852
323
819
882
838
920
P
d Part a Part b d d Part a Part b Part c

SHIFT MECHANISM IN SYLLABIC TYPEWRITERS

CROSS-REFERENCES TO RELATED APPLICATIONS

This application is a division of my application Ser. No. 359,051 filed June 2, 1972, which has been refiled as continuation application Ser. No. 502,188 filed Aug. 30, 1974

BACKGROUND OF THE INVENTION

1. Field of the Invention

Syllabic typewriters having different cases of characters.

2. Description of the Prior Art

A syllabic typewriter with a shift mechanism has already been disclosed by Gremillet U.S. Pat. No. 3,073,427.

The Invention comprises different improvements to this Prior Art. In particular it permits the utilization of a motor. It increases the typing speed and permits a better printing quality.

SUMMARY OF THE INVENTION

In a first embodiment:

a shift mechanism which allows the typist to put different groups of type bars in three different case positions, certain of these groups being each movable independently from the others. A vertically movable carriage cylinder is combined with different sectors which are also vertically movable, either together or individually.

In a second embodiment:

a shift mechanism which allows the typist to put different groups of type bars in three different case positions.

Certain type bar groups are each movable independently from the others.

The mechanism comprises a general basket on which certain type bar groups are directly fixed, these groups being movable only together and with the general basket. The general basket is slidably supported by the frame of the typewriter. Other type bar groups, with their respective sectors, are each slidably supported by the general basket and thus are each movable individually.

When all the sectors are to be displaced, the general basket is displaced with all the sectors. This principle gives better printing than when all the sectors are displaced simultaneously but separately.

In this second embodiment the device comprises at least two driving shafts (a first and a second) engaged with one another, so that they oscillate simultaneously but in opposite directions. These shafts bear each different levers. On account of lack of space in the center of the machine, the secondary driving shaft is replaced by two secondary driving shafts which are aligned with one another.

When one sector or the general basket is to be displaced downwards it is engaged on one or two levers borne by the first driving shaft.

When the general basket is to be displaced upwards it is engaged on two levers borne by the secondary driving shafts.

In this case, the first driving shaft is engaged with a motor element which reciprocates the first and secondary driving shafts in opposite directions.

In the two embodiments, the device comprises an arrangement of thin sheets each situated between the path of movement of the type bars belonging to two successive type bar groups. These thin sheets constitute each a support for a corresponding cushion on which rest the type bar heads. They avoid collisions between type bars belonging each to one of two successive groups. They also constitute type bar guides between these groups.

A combination between the two embodiments permits putting the type bar groups into four different case positions, which permits building the machine with four characters on each type bar.

Escapement bars of Groups I to V

Figures 10, 11, 12, 13, 14, 15, 16, 17, 18, 19, 20, 21, 22, 23:
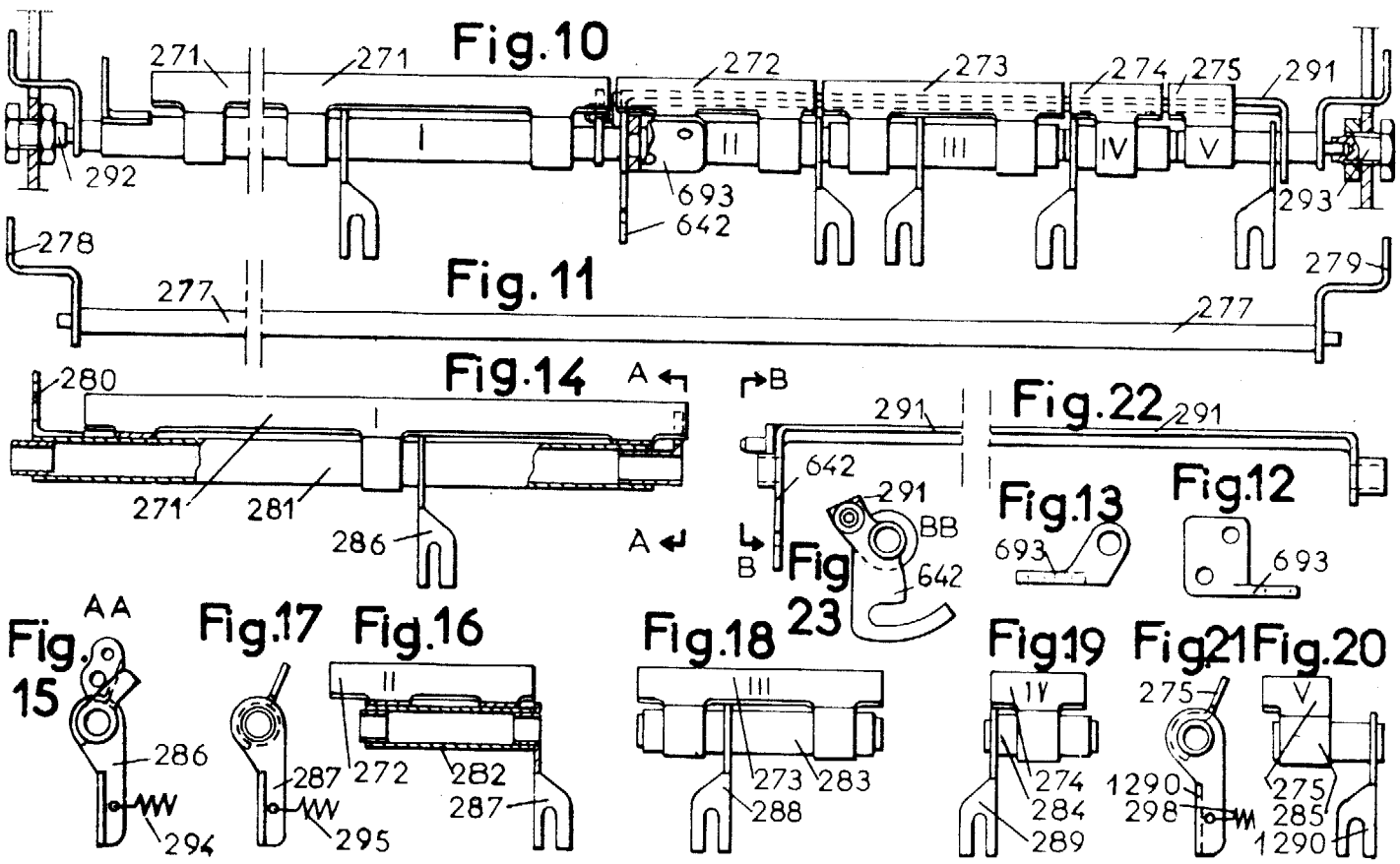
FIG. 10. The whole of the group escapement-bars, actuated by the lower ends of the intermediate levers. Front view.
FIG. 11. Axle of the group escapement-bars. Front view.
FIG. 12. Central bearing of the group escapement-bar axle. Front view.
FIG. 13. Central bearing of the group escapement-bar axle. View from the left.

| | Front view | View from the right |
|---|---|---|
| Group I | FIG. 14 | FIG. 15 |
| Group II | FIG. 16 | FIG. 17 |
| Group III | FIG. 18 | FIG. 21 |
| Group IV | FIG. 19 | FIG. 21 |
| Group V | FIG. 20 | FIG. 21 |

FIG. 22. Lever for raising the ribbon, actuated by the groups escapement bars of Groups I to V. Front view.

FIG. 23. Lever for raising the ribbon, actuated by the group escapement bars of Groups I to V. View from the left.

Figures 24, 26:
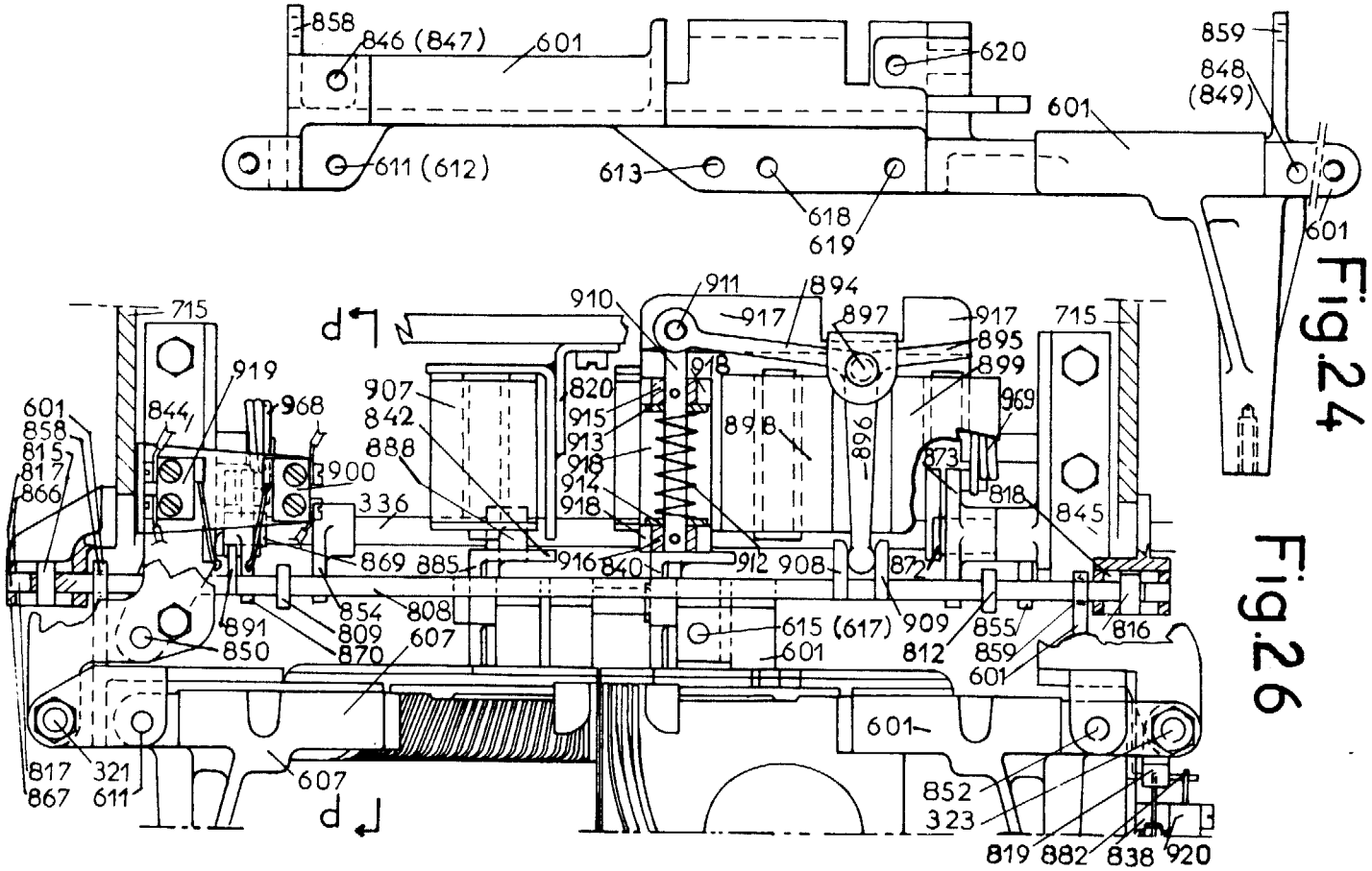

FIG. 24. Frame of the general three-position "basket". Top view.

Figure 25:
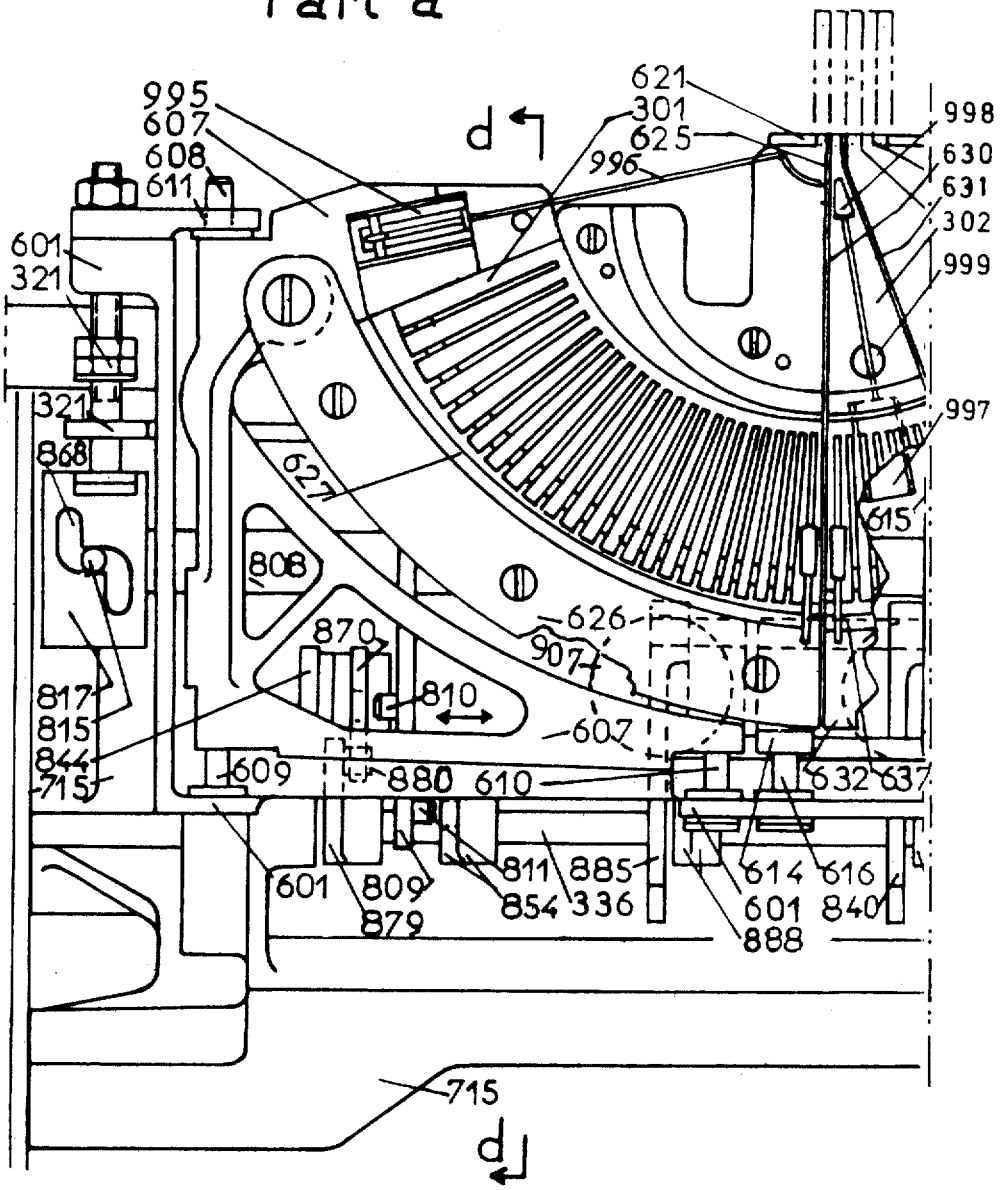
Figure 25:
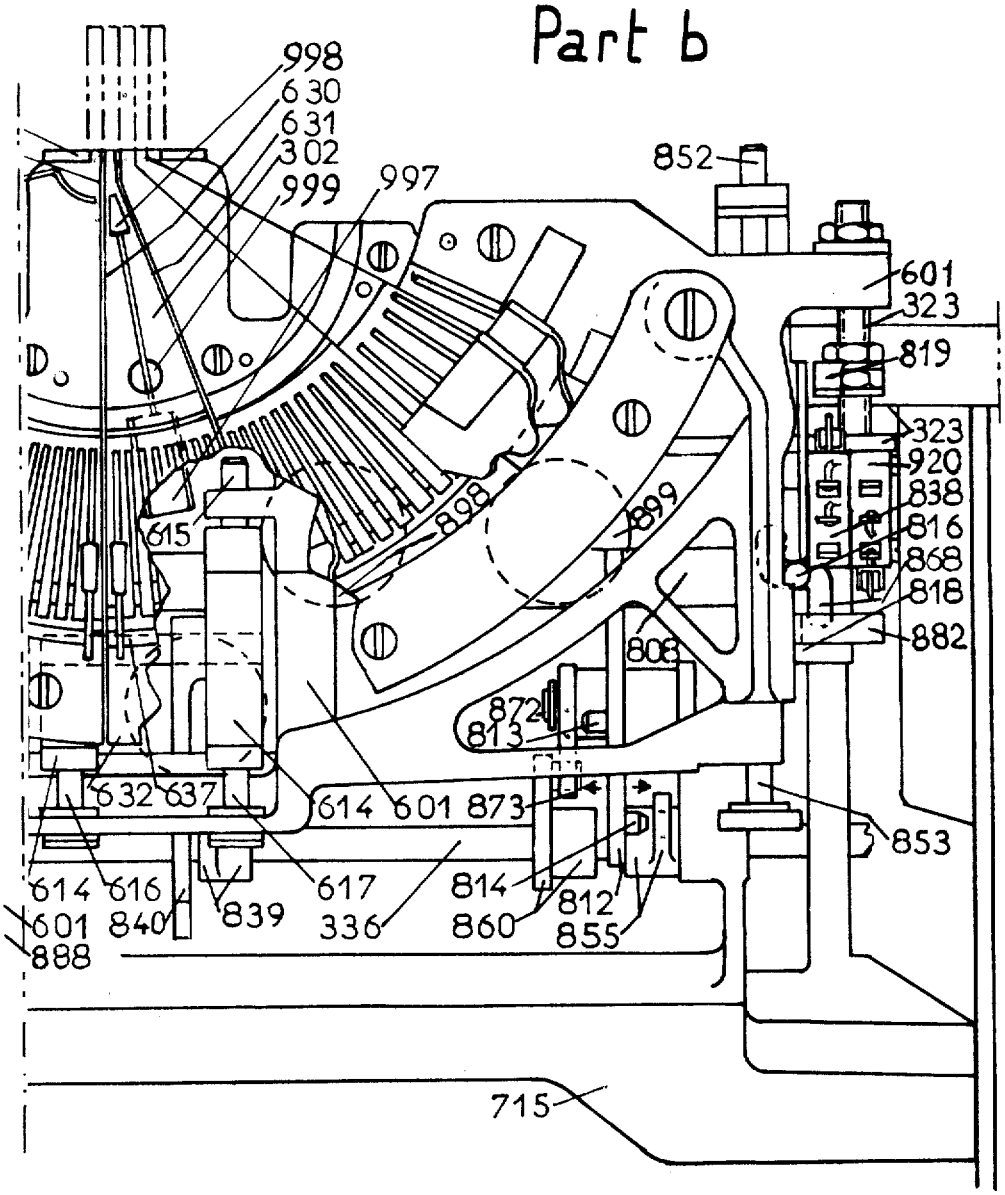

FIG. 25. Comprising parts designated 25*a* and 25*b*. The three three-position "baskets", assembled, bearing the sectors, and parts of the devices that actuate them. Front view. FIG. 26. The three-position "baskets", assembled, bearing the sectors, and parts of the devices that actuate them. Top view.

Figure 27:
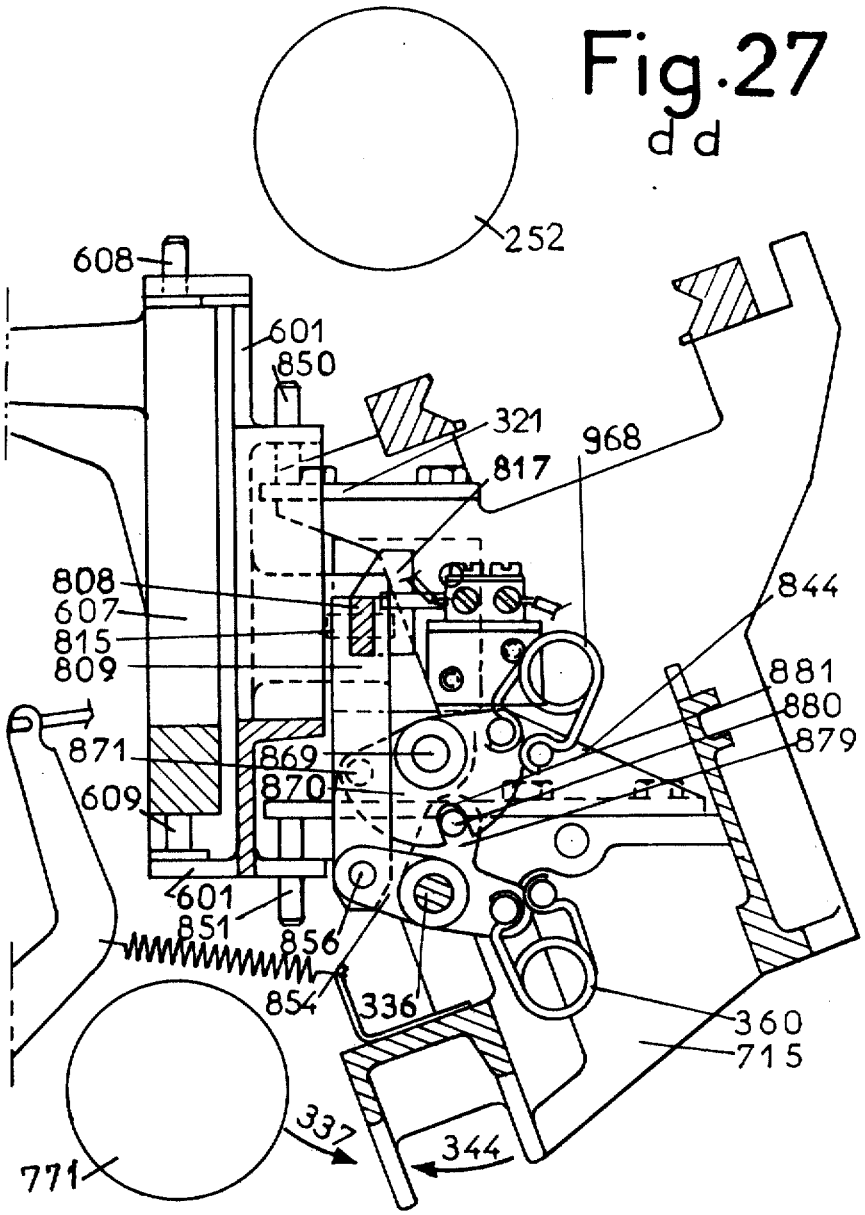

FIG. 27. Three-position "basket" I, slidably mounted on the general "basket", and mechanism actuating the three "baskets". Section d–d of FIGS. 25 and 26, seen from the right.

Figure 28:
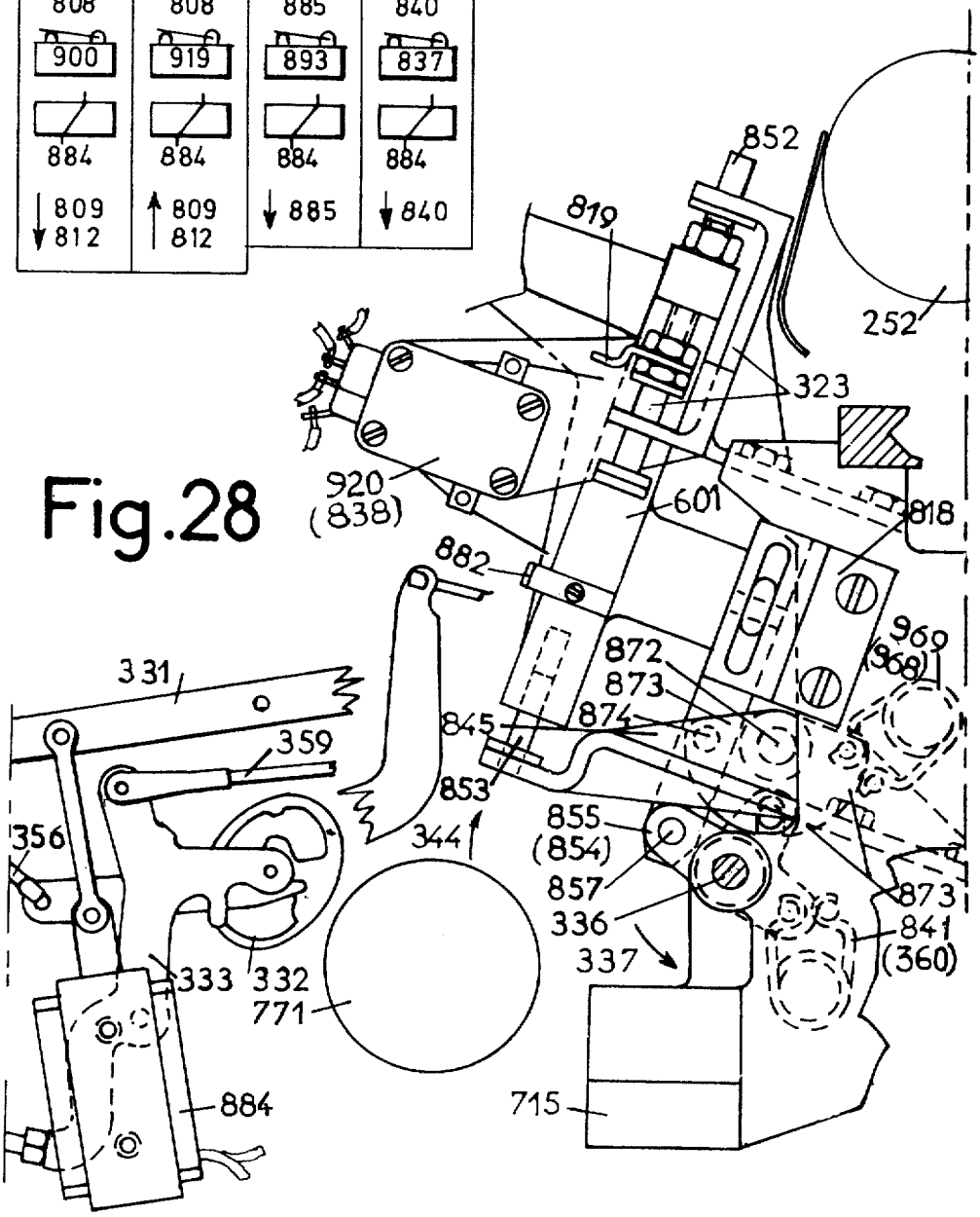

FIG. 28. General three-position "basket", slidably mounted on the frame of the machine, and device for actuating the three "baskets". View from the right.

Figure 29:
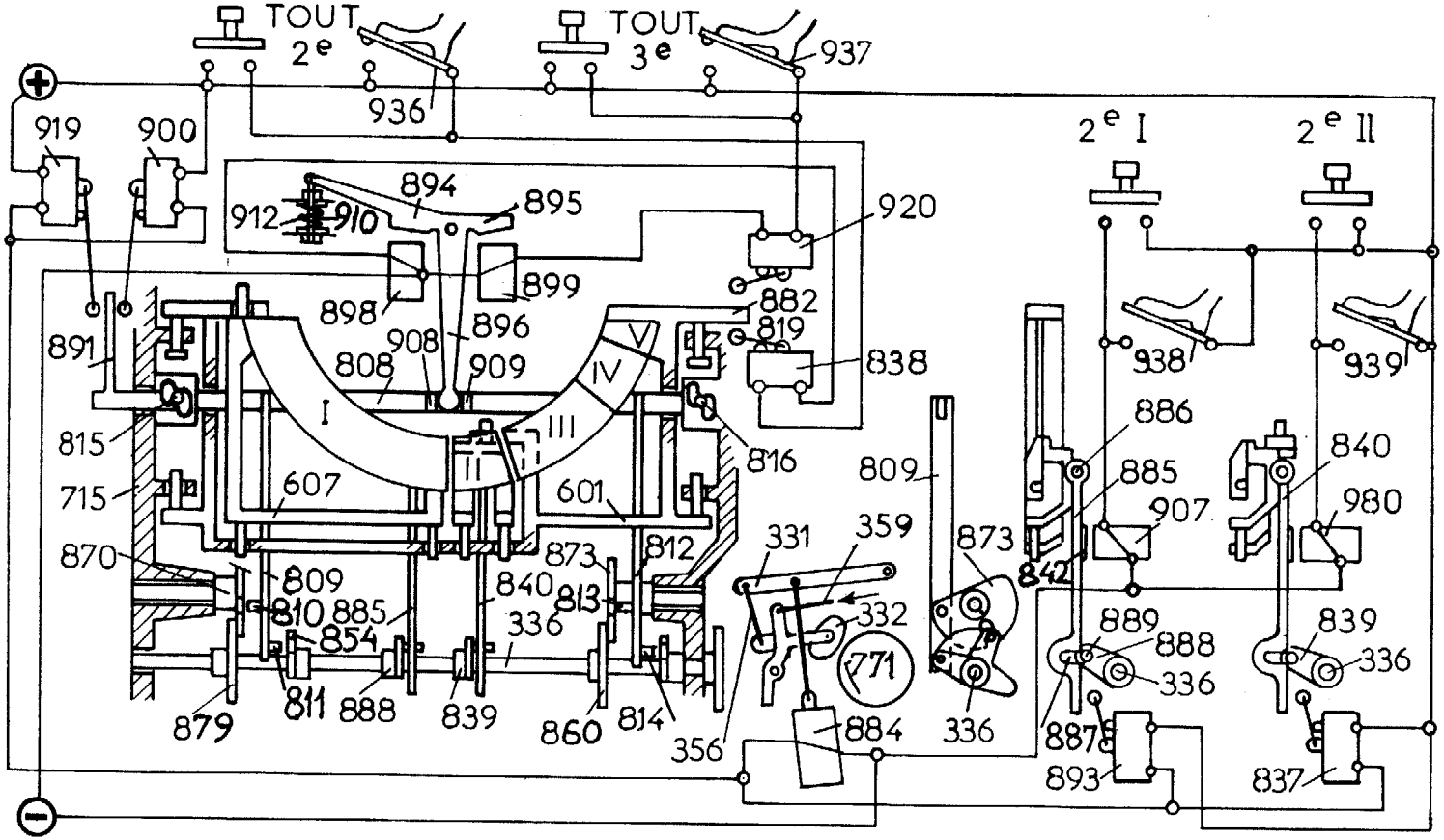

FIG. 29. Scheme of the assembly of the electric circuits that actuate the changes of position of the three three-position "baskets".

Figure 30:
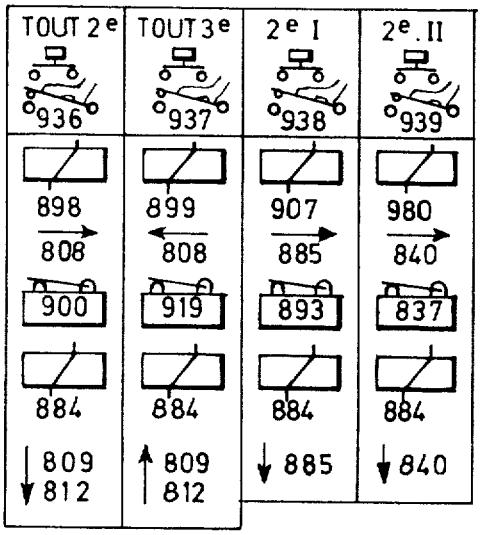

FIG. 30. Synoptic table setting out the sequence of effects produced by depressing each of the sector shift keys, or by depressing the pedal that duplicates them.

Figure 31:
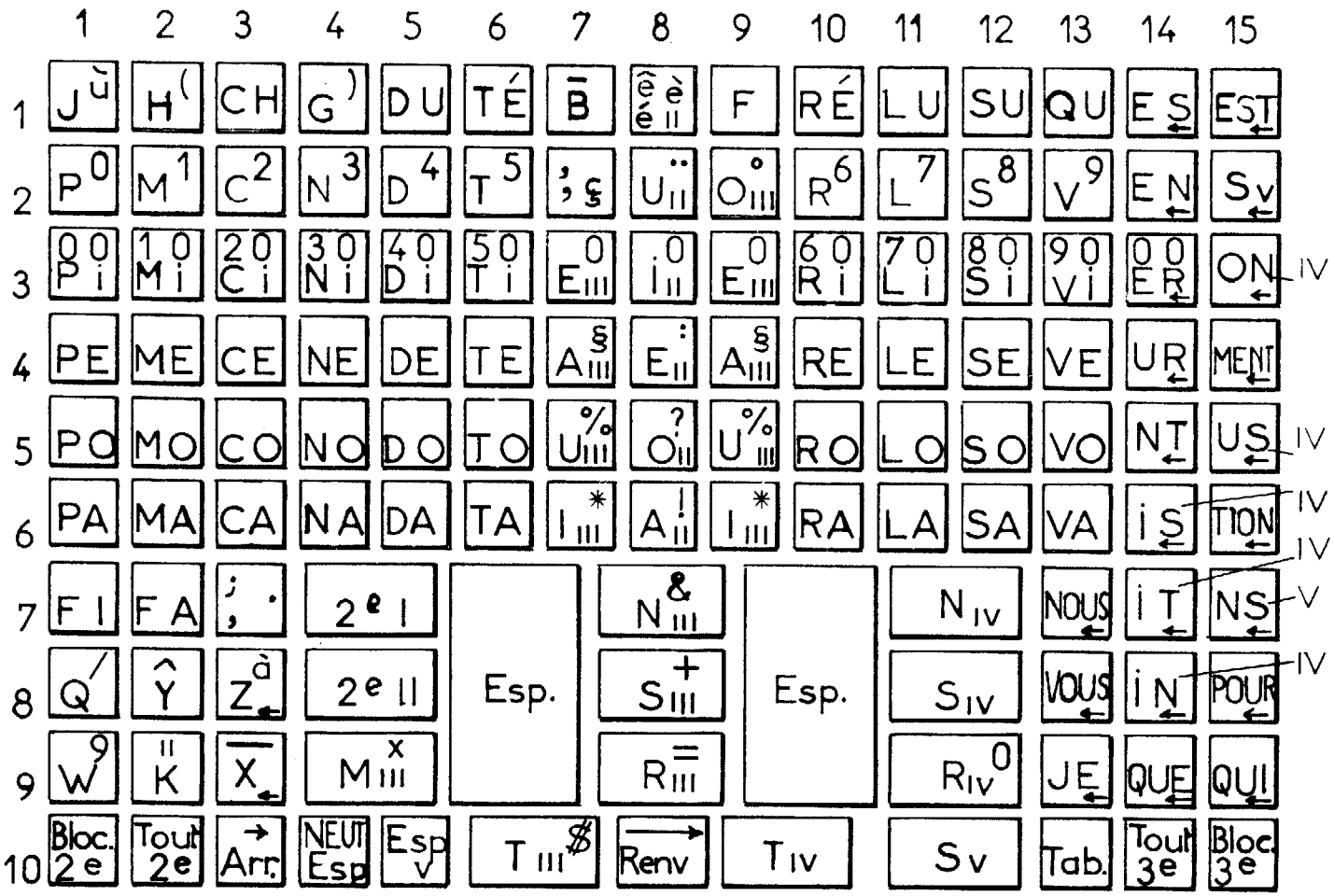

FIG. 31. Switchboard. Example of a layout for the French language.

Figure 32:
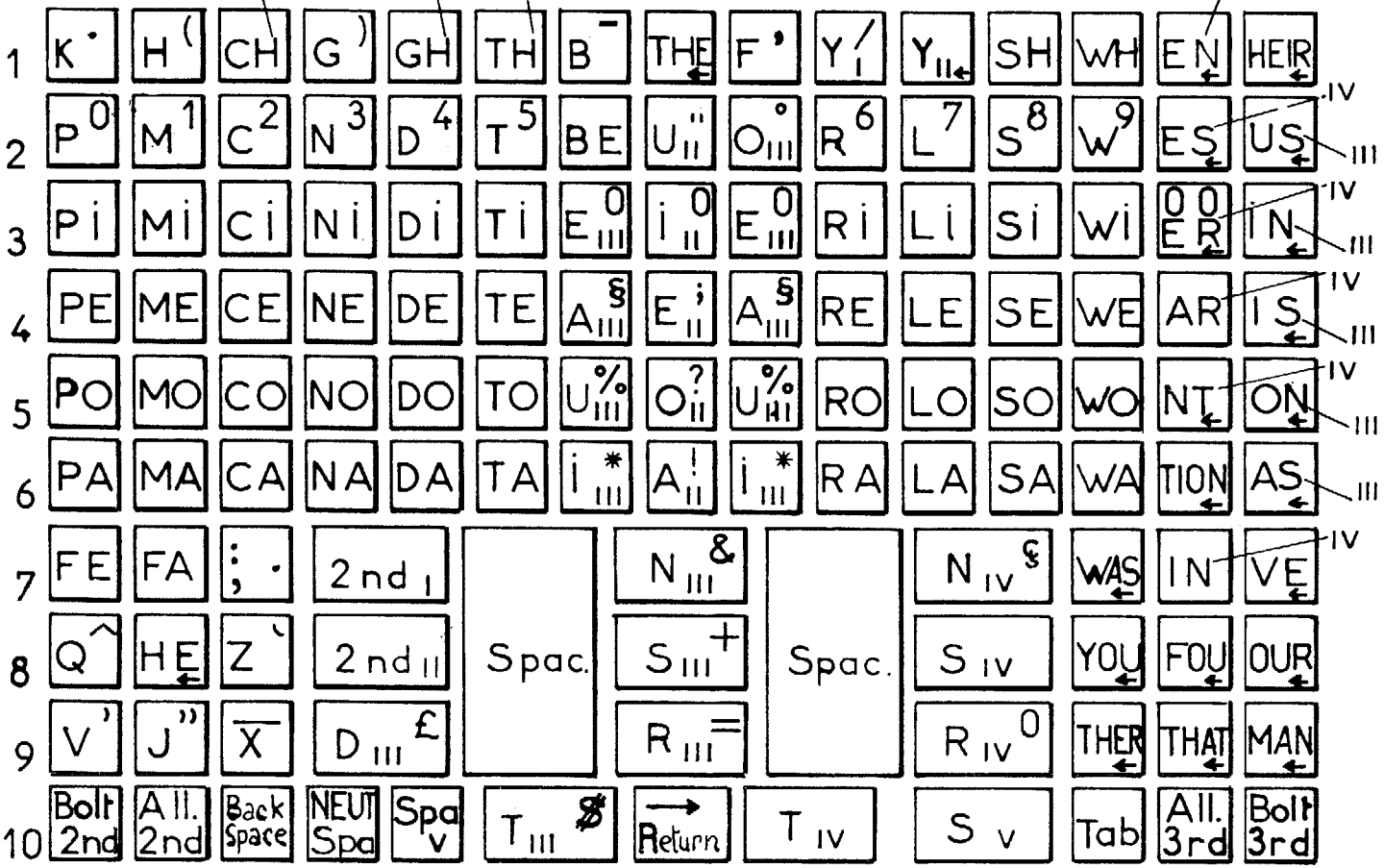

FIG. 32. Switchboard. Example of a layout for the English language.

Figure 33:
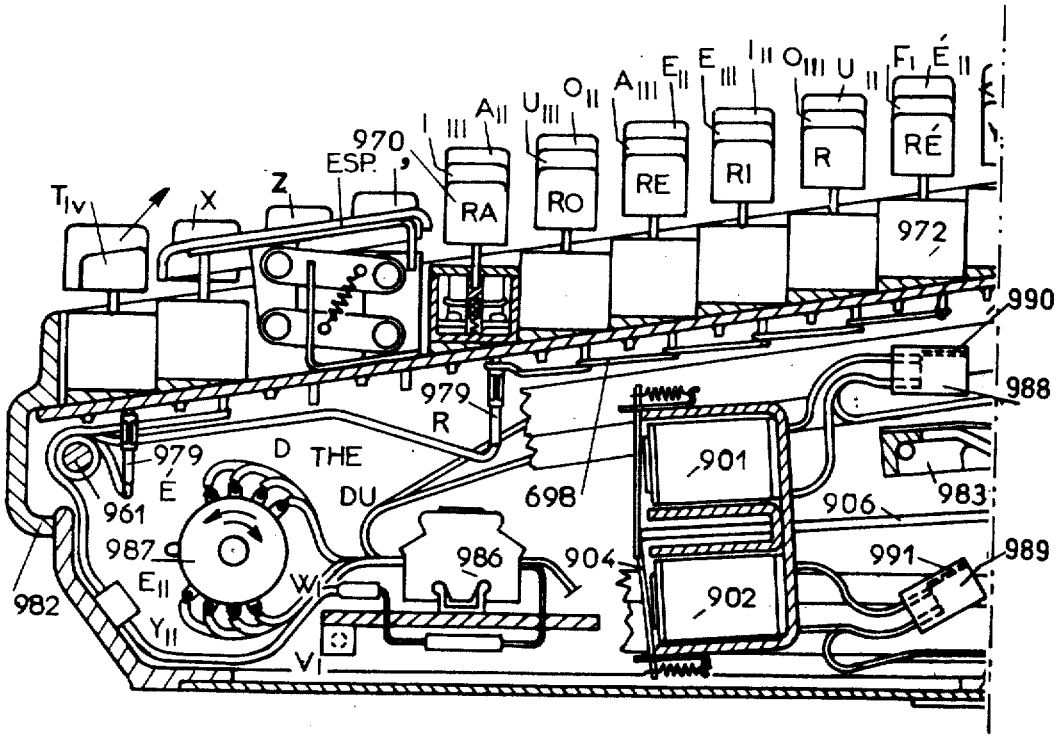
Figure 33:
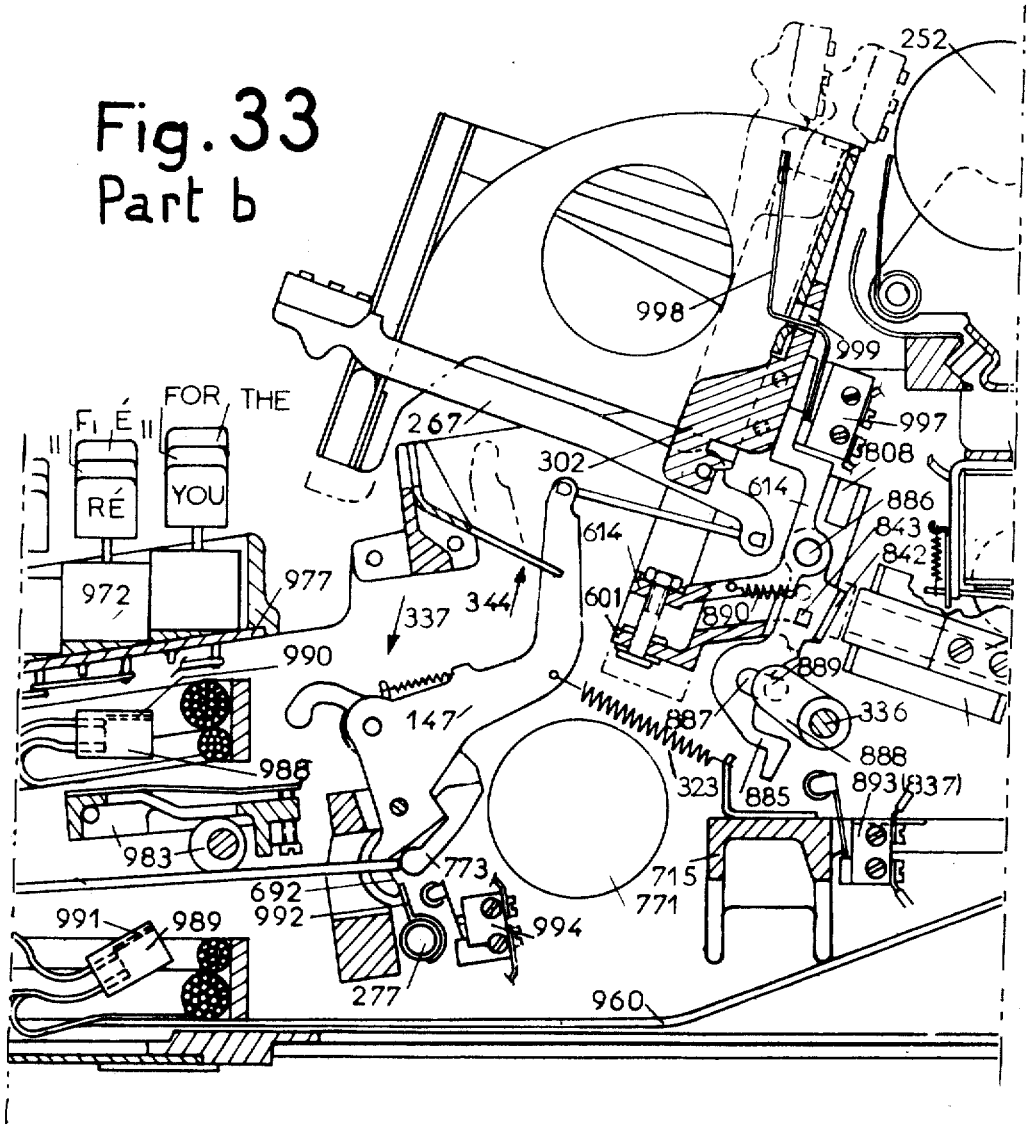
Figure 33:
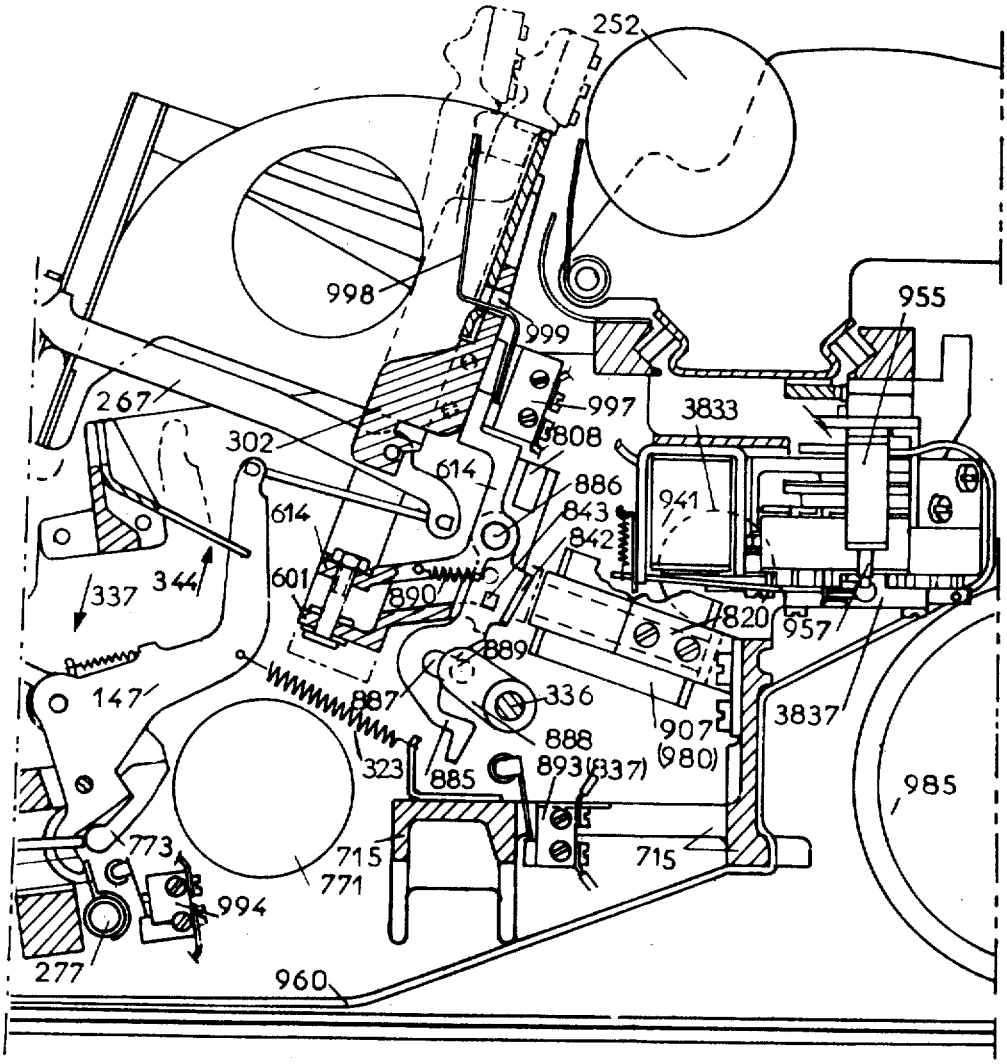

FIG. 33. Comprising parts designated 33a-33c. The whole machine in the version comprising a keyboard made up of swiches that actuate the engagements on the driving cylinder and the escapement mechanism provided with electromagnetic means. Longitudinal section seen from the right.

DESCRIPTION OF THE PREFERRED EMBODIMENTS

General considerations.

In the embodiments presented, the power of a smooth motor-driven cylinder is employed for printing and for different associated functions, as well as intermediary levers and other elements normally used in non-syllabic electric typewriters.

The machine described may evidently be adapted so as to employ similar elements borrowed from electric typewriters of another type. For example, a grooved motor-driven cylinder and levers similar to those normally used in such cases could be employed.

Different parts of the machine that do not form part of the invention are shown only schematically and insofar as is necessary to locate the new devices or make their connections with the latter understandable.

Thus it is, for example, with the motor, the motor-driven cylinder, type-bars and certain electronic components.

Figure 1:
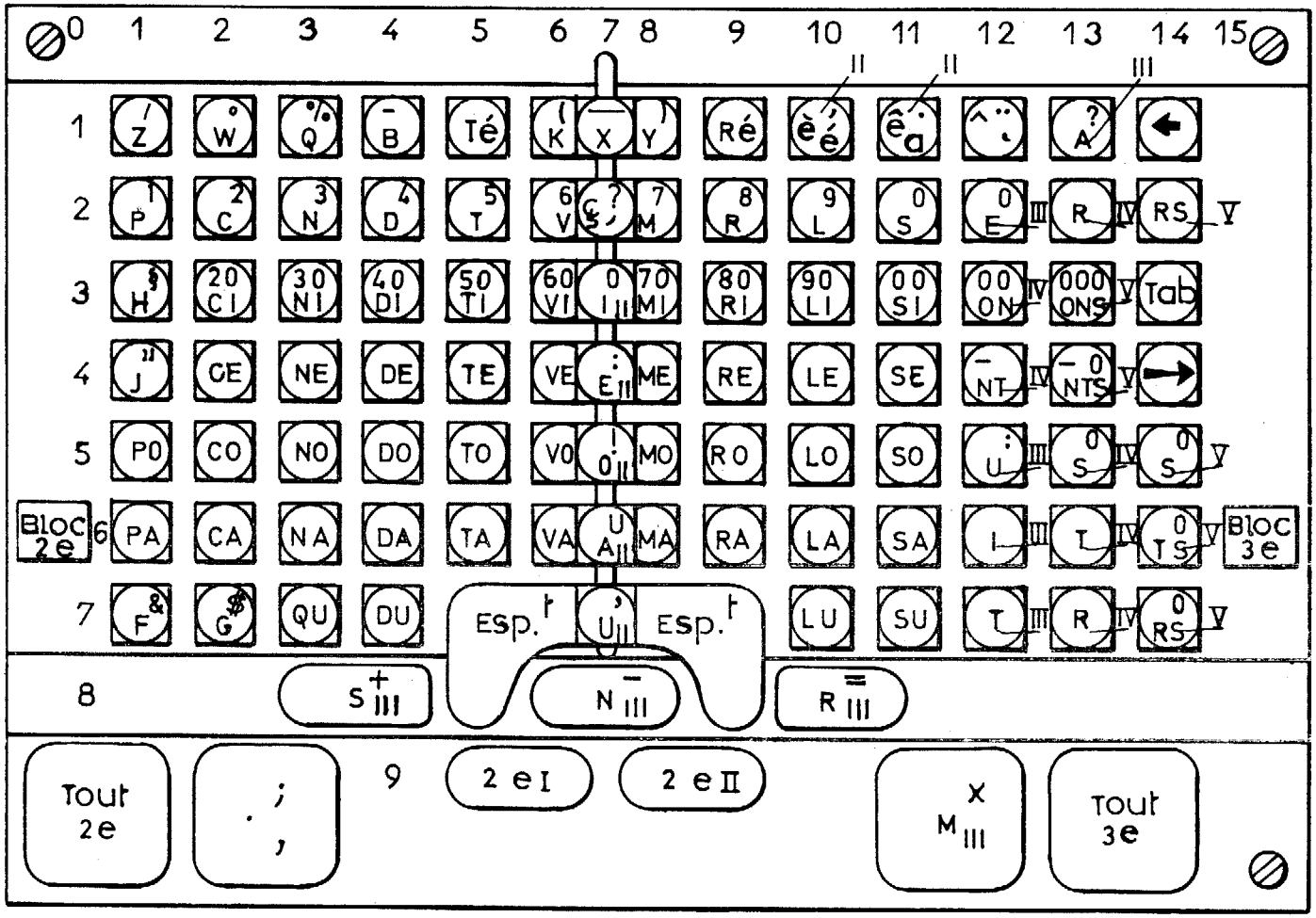
FIG. 1. Keyboard of a type that allows the use of only mechanical connections. Layout for the French language. Top view.
Figure 2:
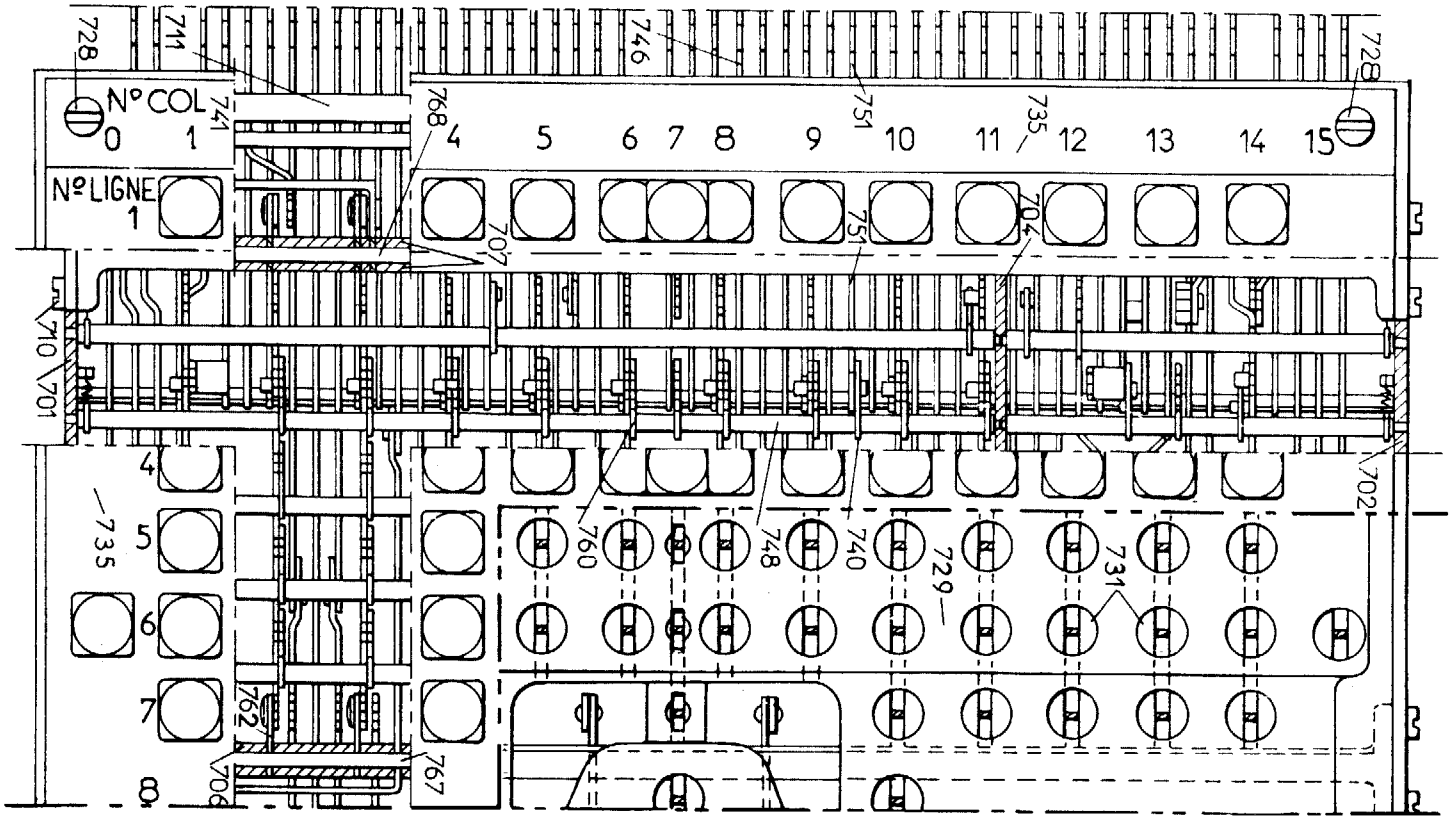
FIG. 2. Part of the mechanical connection box superimposed on the longitudinal levers, the keyboard being partly removed to show the articulated parallelograms combined with the device for transverse deflecting of the movement (counter-motion device). Top view.
Figure 3:
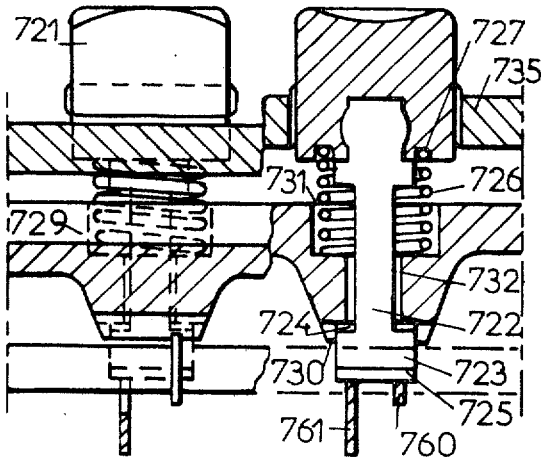
FIG. 3. Two keys each with its double-angular-edge knife, driving simultaneously a parallelogram that corresponds to the column and a transverse counter-motion device corresponding to the row. Front view.
Figure 4:
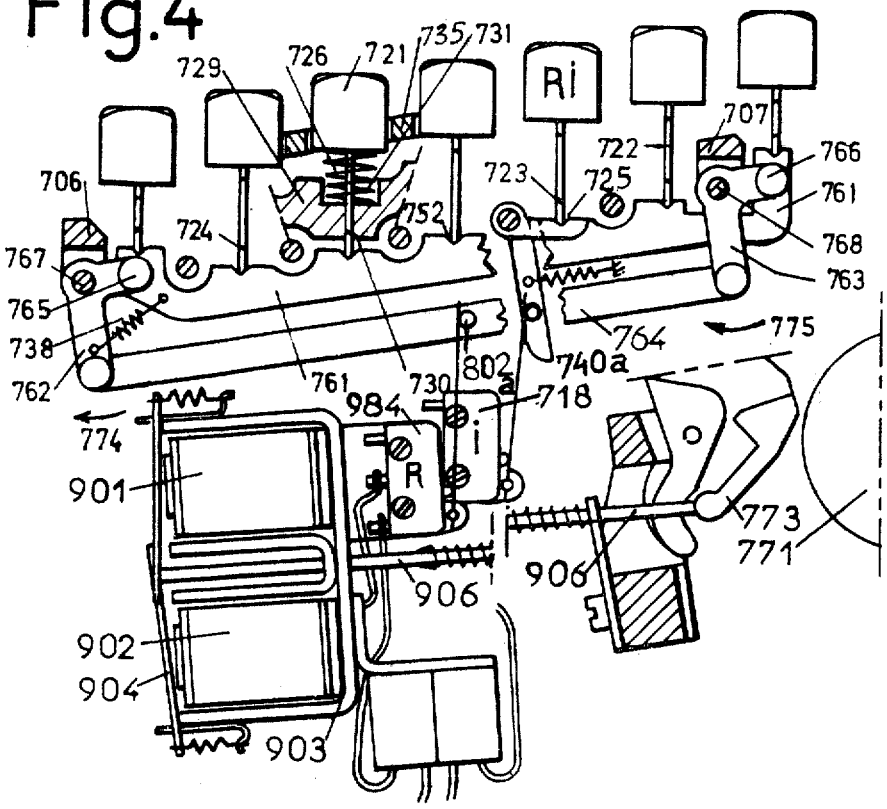
FIG. 4. One of the articulated paralleograms, the keys that actuate it, one of the counter-motion devices, and electromagnets each of which engages a cam on the driving cylinder. View from the right.

In a first embodiment described hereafter, it is presumed that the keyboard is similar to that described in U.S. Pat. No. 3,073,427. FIG. 1. illustrates the structure and layout of this keyboard.

In a second embodiment, the machine is provided with electromagnets. Electrical and electronic connections then replace numerous mechanical connections, giving greater freedom for the layout of the keyboard.

FIG. 1 is an example of a keyboard that may be adapted when the connections are solely mechanical, and also when they are electrical and electronic.

FIG. 32 shows a type of keyboard that can only be adopted when the machine is furnished with electromagnets. This keyboard includes, among other features, keys for large combinations ("that", "heir", "tion" etc) that enable, by depressing a single key, the printing of up to four characters at a time, and the simultaneous production of the space that has to follow them. On the other hand, numerous keys corresponding to Groups III and IV ($E_{III}$, $N_{III}$, $T_{IV}$) are situated at the centre of the keyboard to facilitate the fingering.

Shift mechanism

Figure 5:
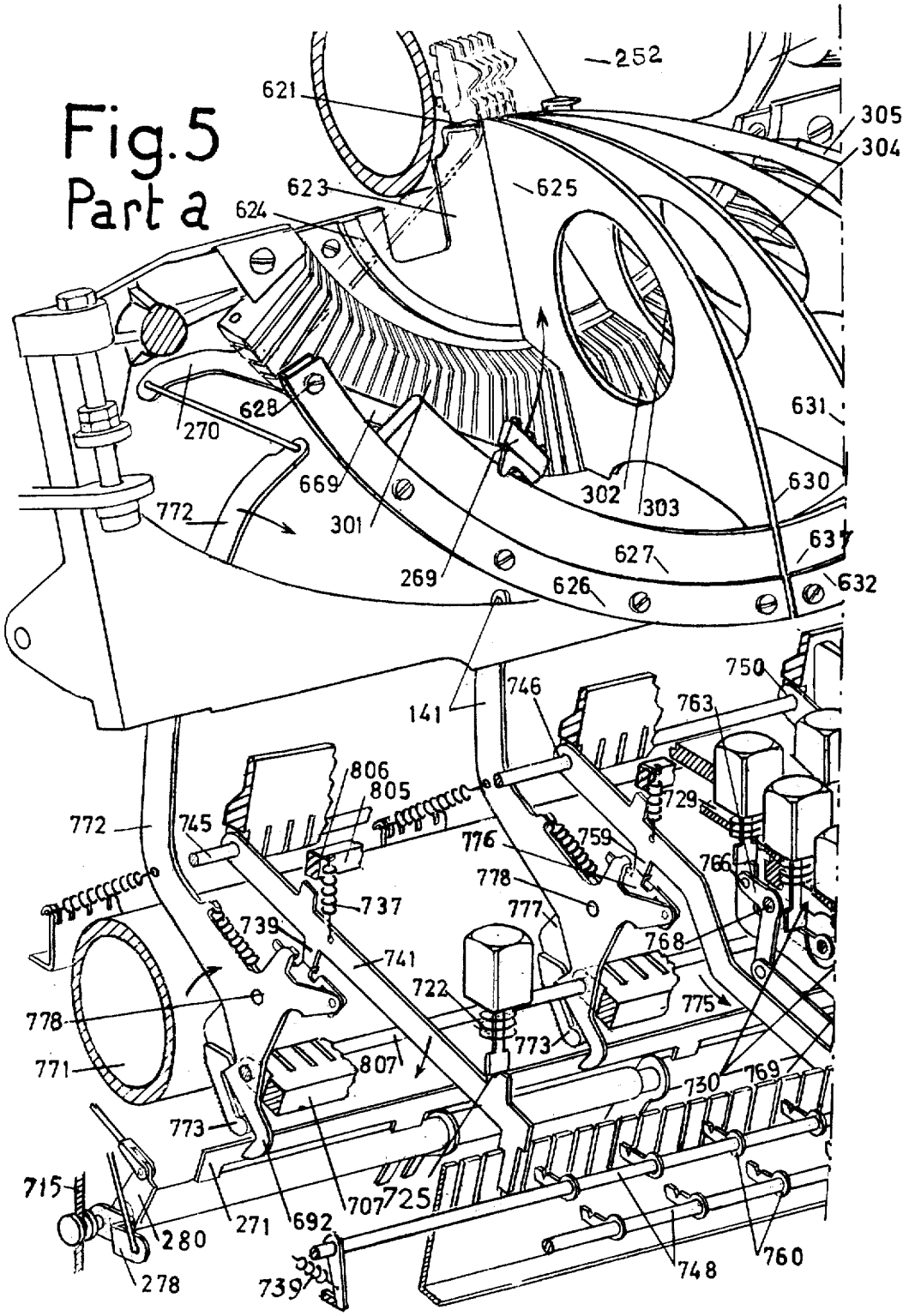
FIG. 5. Comprising parts designated 5*a*, 5*b*, 5*c*. Printing mechanism. Partial view, in perspective.
Figure 5:
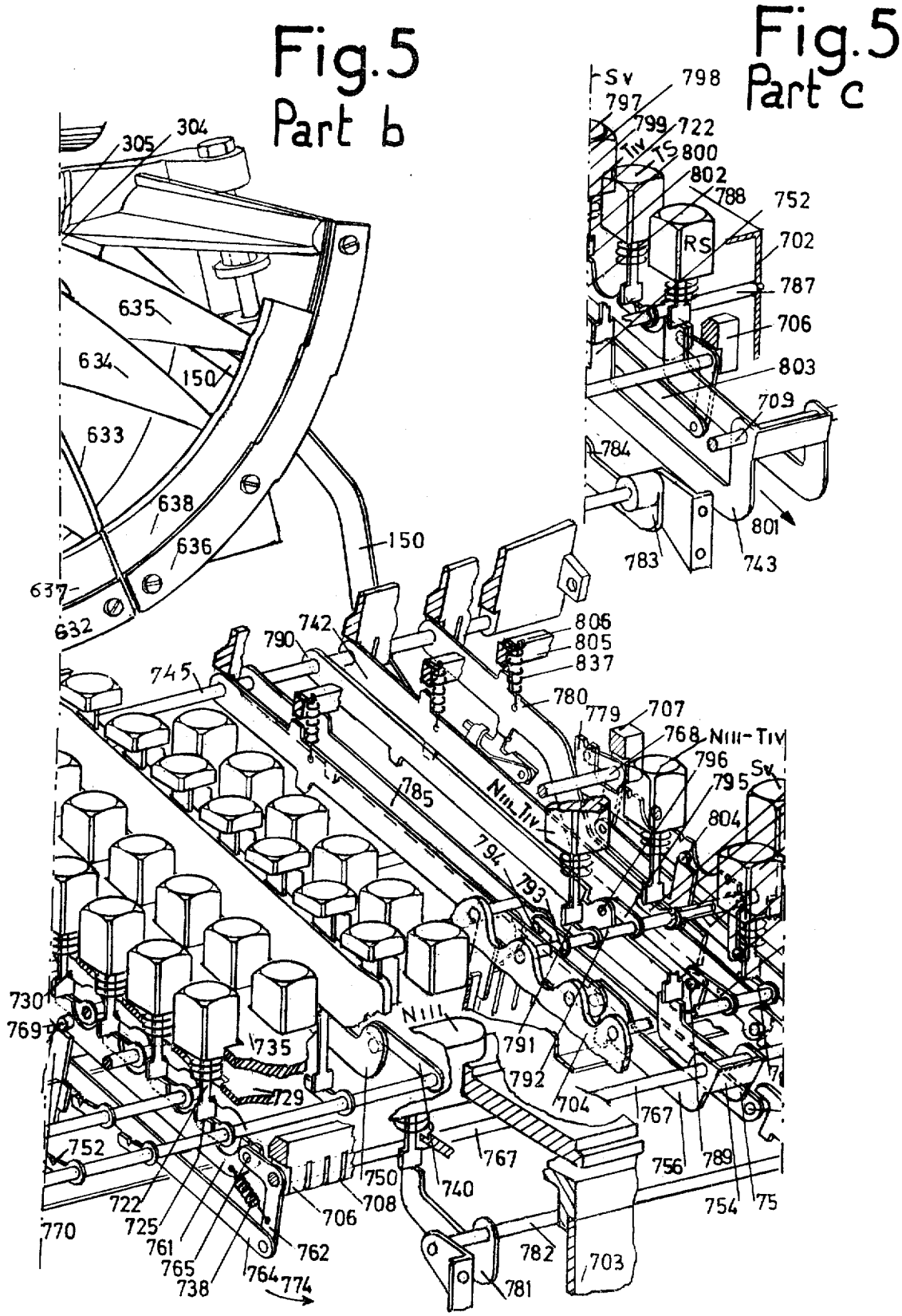

The machine includes five groups of type-bars, borne by five sectors 301 to 305 (FIG. 5).

Each type-bar has three characters placed one above the other, the characters thus belonging to three different cases. Therefore, the sectors must be able to occupy, relative to the carriage cylinder (platen), three different case positions : the 1st for small letters; the 2nd for capital letters; and the 3rd for figures, various signs and special characters.

Combination of the descent of the baskets and the rise of the carriage cylinder.

In the embodiment described here, in order to be able to print a character of the 2nd case in Group I or in Group II, the sector corresponding to this group must be made to descend. It is also possible to make all the sectors descent simultaneously.

In order to print the characters in the 3rd case, the sectors may descend by twice the amount which brings them to the 2nd position. This solution was disclosed in U.S. Pat. No. 3,073,427. In the embodiment described here, the third case position is obtained by simultaneously making the sectors descend and making the carriage cylinder ascend. In a variation, a solution will be described that consists in making the sectors descend so as to reach the 2nd position, but in making them rise in order to reach the 3rd position.

The rise of the carriage cylinder is a method that has already been used in some nonsyllabic typewriters in order to reach the 2nd case position. Two methods already well-known individually are therefore combined. This necessitates the realization of a special driving device. On the other hand, Sector I, 301 (FIG. 5) must descend alone, as may Sector II (302). On the contrary, Sectors III (303) IV (304) and V (305) are fixed on a common support and they can only be made to descend at the same time as the Sectors I and II. There are thus three sector supports.

In order for each of these supports to be displaceable between the 1st and 2nd positions, each is fixed to the forward end of lower and upper flexible sheets whose rear end is fixed to the frame of the machine. Each pair of sheets, of which there is an upper and a lower, make up the opposite sides of an articulated parallelogram. This is the proces already employed in certain electric typewriters.

Figure 8:
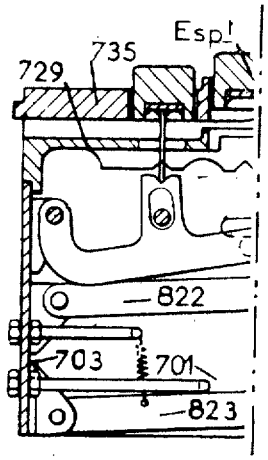
FIG. 8. Comprising parts designated 8*a* – 8*c*. Escapement mechanism and printing mechanism. Longitudinal section, seen from the right.
Figure 8:
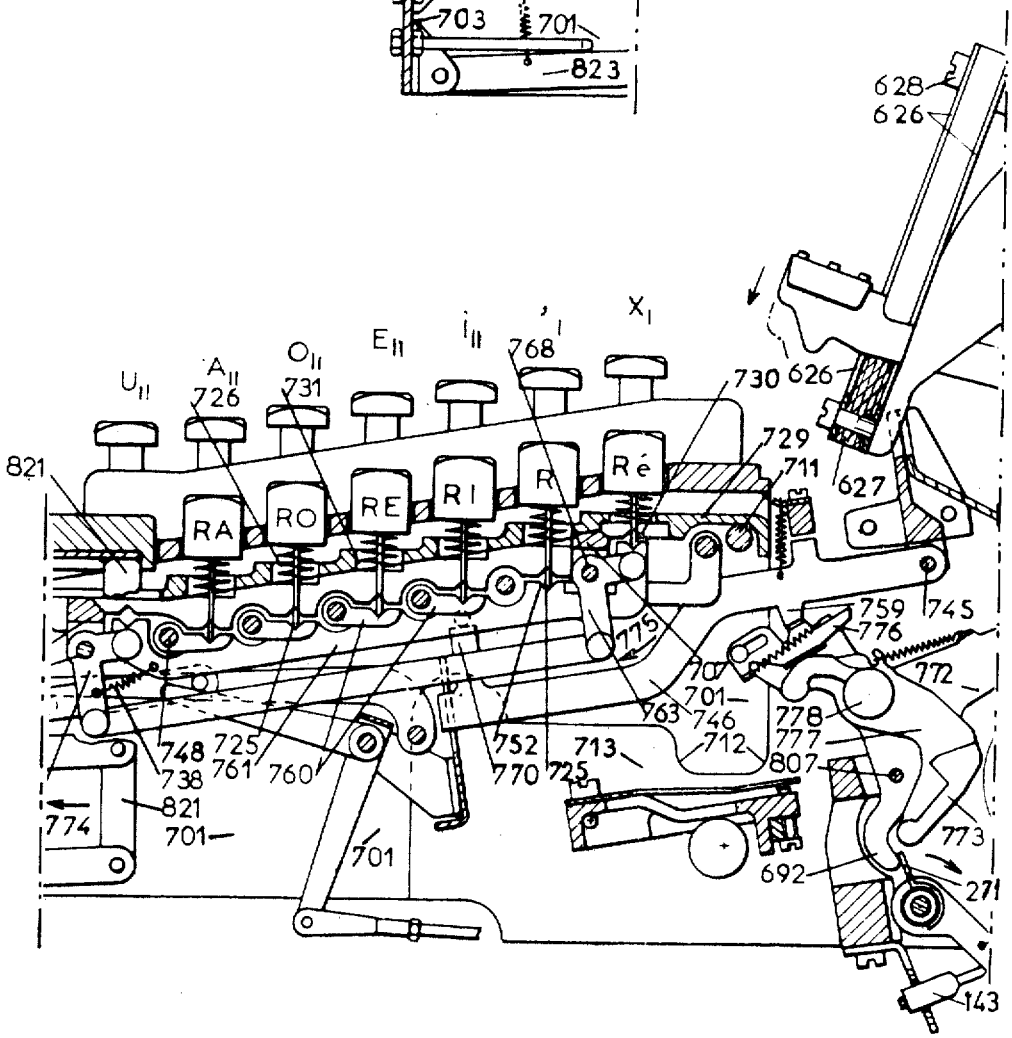
Figure 9:
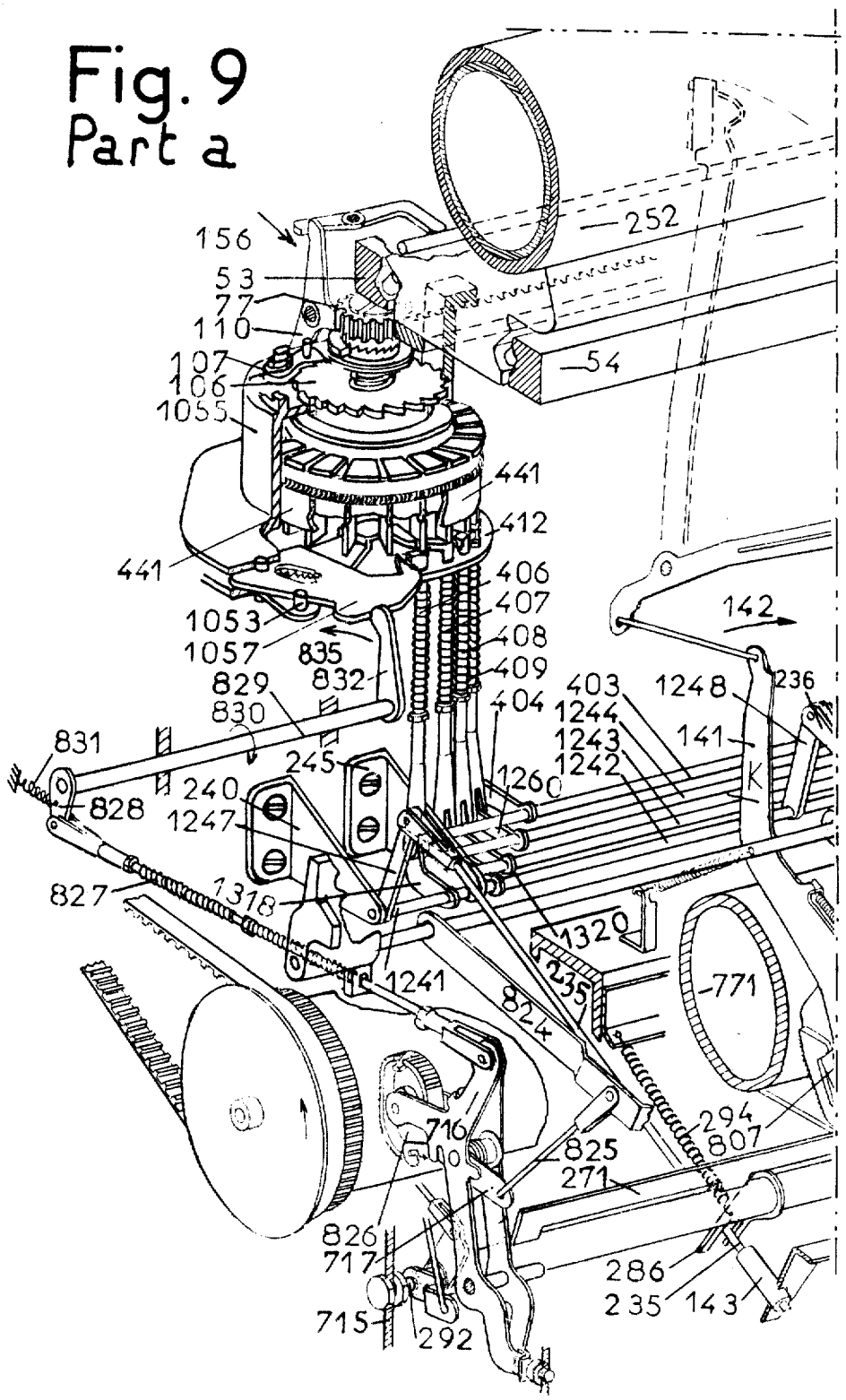
FIG. 9 comprising parts designated 9*a*, 9*b*. Escapement mechanism. Perspective.
Figure 9:
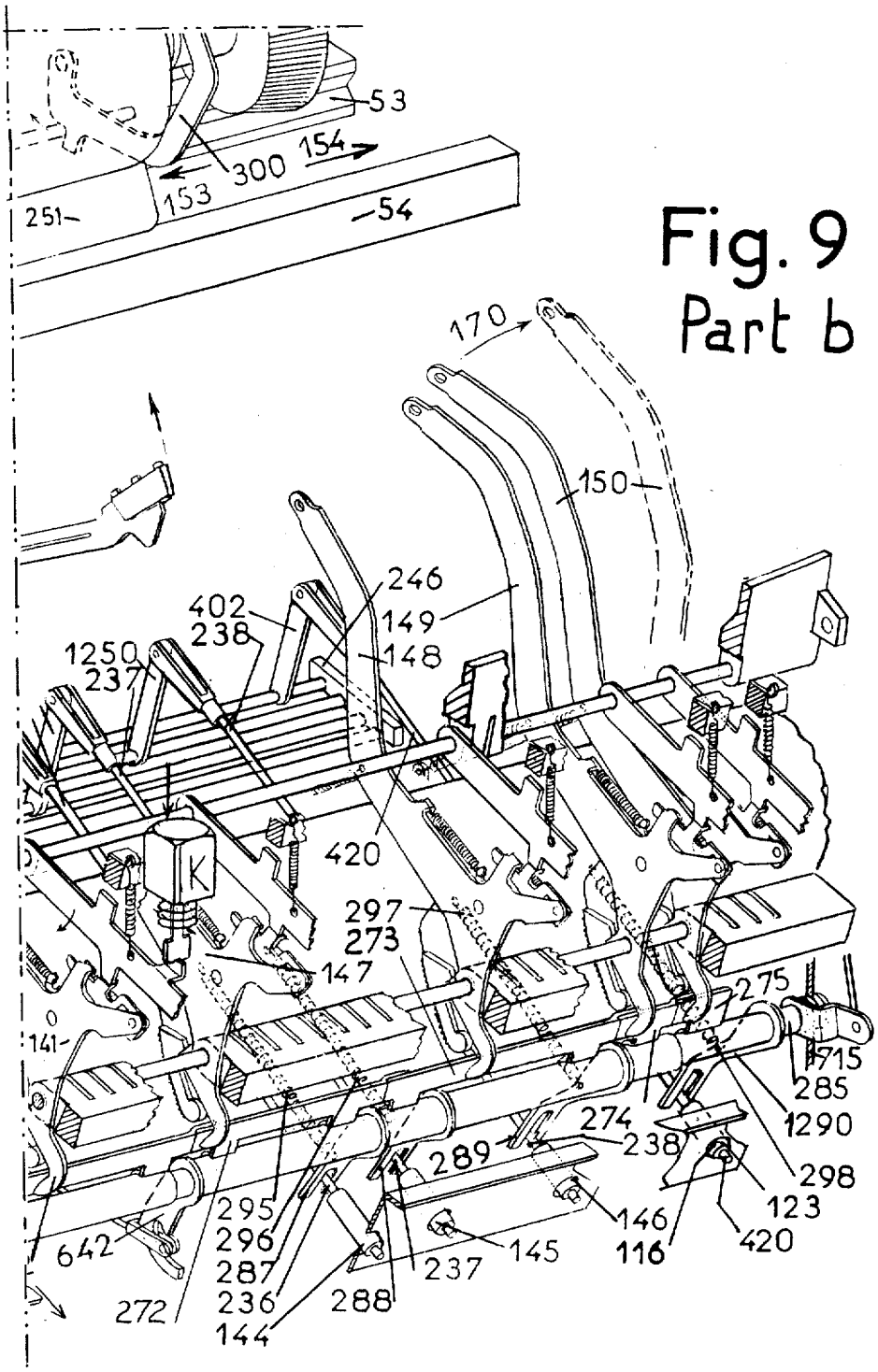

The support of Sector I (301) is fixed to two pairs of sheets 201–202 and 203–204 (FIG. 8). The support of Sector II (302) is fixed to a single pair of sheets, identical with the preceding, because it is narrower. The common support of the Sectors III, IV and V is fixed to two pairs of sheets like the support of Sector I. "Basket" is the name give to each set of parts which, for changes of case position, can only be displaced in its entirety and which is supported by the same flexible sheets; that is to say to each whole that consists of : a sector support, the sector or sectors that the latter supports, type-bars and corresponding type-bar guides. There are, then, three baskets, (FIG. 5) corresponding respectively to Group I, to Group II and to the Groups

III-IV-V.

The displacement of each basket is limited above and below by adjustable double stops as follows : for basket I, to the left, the double stop 321 (FIG. 6) the type of which is well-known, consisting of nuts and shock-absorber washers, mounted on a single axle; and to the right, the double stop whose support is made up of a fork 322, seen from the right in FIG. 8. For basket III-IV-V there are two double stops 323 and 324 (FIG. 6) identical with those for basket I but in the reverse order, Basket II is stopped by a single double stop 325 identical with the right-hand double stop 322 of basket I. The three central double stops are identical. They may be adjusted in the following manner; the fork-stop that constitutes each of them is fixed to a support 326 (FIG. 8) by two screws in elongated holes. The two ends 327 and 328 of the fork-stop being slightly flexible, they may be brought nearer to or farther from one another by the screw 329 that passes through an unthreaded hole in the upper end 327 and screws into the lower end 328.

Each one of the three baskets is pushed towards each upper and lower stop at each side of an equilibrium point by one spring or two, such as 330, in the normal way. There are thus two springs for each of the baskets I and III, but one spring only for basket II.

A device, which will be described, effects the passage to the second case position and then the return to the first case portion, either for the three baskets together, or for basket I alone, or for Basket II alone.

This device consists basically of the same parts as a device used for displacing the single basket in ordinary electric typewriters. These are principally : a longitudinal lever 331 (FIG. 6) driven by shift keys; a connecting-rod 355; an anchor-push member 334, mounted so as to pivot on a lever 358; a plate 335, which bears two catch-pins 351 and 352 and is fixed to a driving shaft 336 that bears three wrist-pin levers such as 345, 346 and 347, a connecting-rod 356, a lever 357; a case-shift cam 332 held in rest position by the lever 357, a lever 333 on which the cam is mounted, and a connecting-rod 359. Since all this part of the device is well-known, its functioning will be recalled only briefly.

When the depression of a key causes the longitudinal lever 331 to pivot, the latter, by means of the connecting-rod 355, pulls the anchor-push member 334 so that its upper arm comes in front of the catch-pin 351; and then the connecting-rod 356, pushing on the lever 357, releases the cam 332. The latter engages on the motor-driven cylinder 771. This makes the lever 333 pivot, which, by means of the connecting-rod 359, pulls the lever 358. The anchor-push member 334 advances, pushes the catch-pin 351, which makes the driving shaft 336 pivot, with the wrist-pin levers such as 345, in the direction of the arrow 325, and each wrist-pin lever draws a basket downwards.

When the key is released, the anchor-push member 334 pivots downward and its lower arm pushes the catch-pin 352, and thus the driving shaft 336 as well as the wrist-pin levers pivot in the opposite direction and make the basket rise again.

There will now be described what has been added to this well-known device in order to ensure: that only basket I or basket II should descend; that the three baskets together should descend; or that the three baskets together should descend and in addition the carriage cylinder should rise at the same time.

The descent of the three baskets together into the 2nd case Position

The driving shaft 336 (FIG. 6) bears three identical wrist-pin levers 345, 346 and 347 that pull respectively on three identical trefoil-ended connecting-pieces 348, 349 and 350, each linked to one of the three baskets. A shaft 362 bears four identical radial levers 363 to 366. The key "Tout 2e " (All in 2nd) is mounted on an articulated parallelogram composed of the rod 394, the upper connecting-rod 395 and the reversed lever 396. This last presses on the catch-pin 368. The key "Tout 2e" (All in 2nd) thus drives a longitudinal lever 367 on which the catch-pin 368 is mounted. This catch-pin also makes both the lever 363 and the shaft 362 pivot with the other levers, 364, 365 and 366, that are borne by this shaft. The lever 366 presses on a catch-pin 369, borne by the longitudinal lever 331, thus controlling all the movements of the ordinary device that has been described; and the driving shaft 336, pivoting, pulls on the three connecting-pieces 348 to 350 by means of its three wrist-pins 345, 346 and 347, which makes the three baskets descend into the 2nd case position. The same effect is obtained by depressing the key "Bloc 2e", which, by a device already well known comprising the hook 397, holds the lever 367 and the ensemble in the 2nd case Position.

When the key "Tout 2e" (All in 2nd) is released, the reverse movements take place and the three baskets are thus returned to the 1st Position.

Disconnecting of one or several baskets

Figure 6:
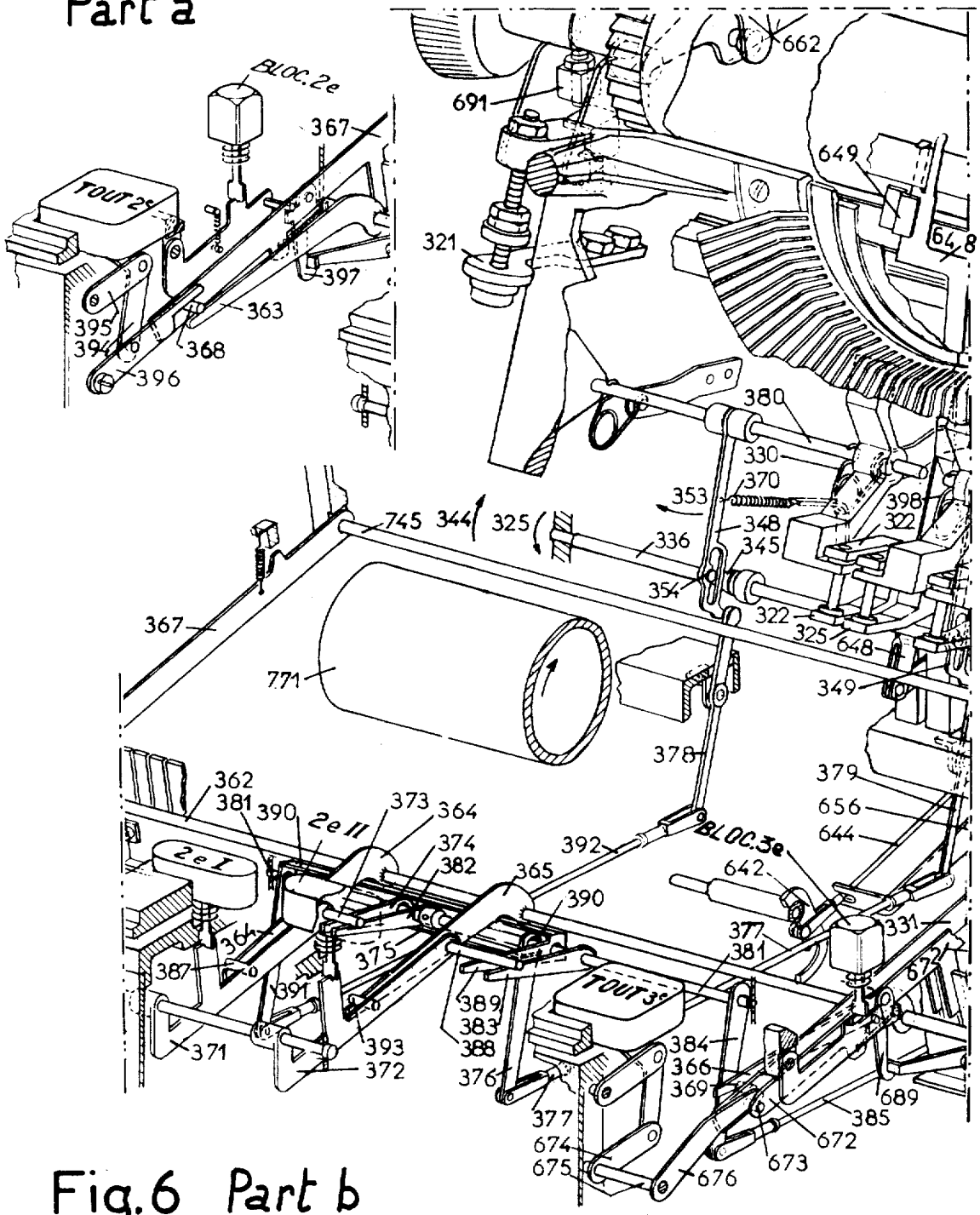
FIG. 6. comprising parts designated 6*a*, 6*b*, 6*c*. Shift mechanism and mechanism for raising the ribbon. Perspective.
Figure 6:
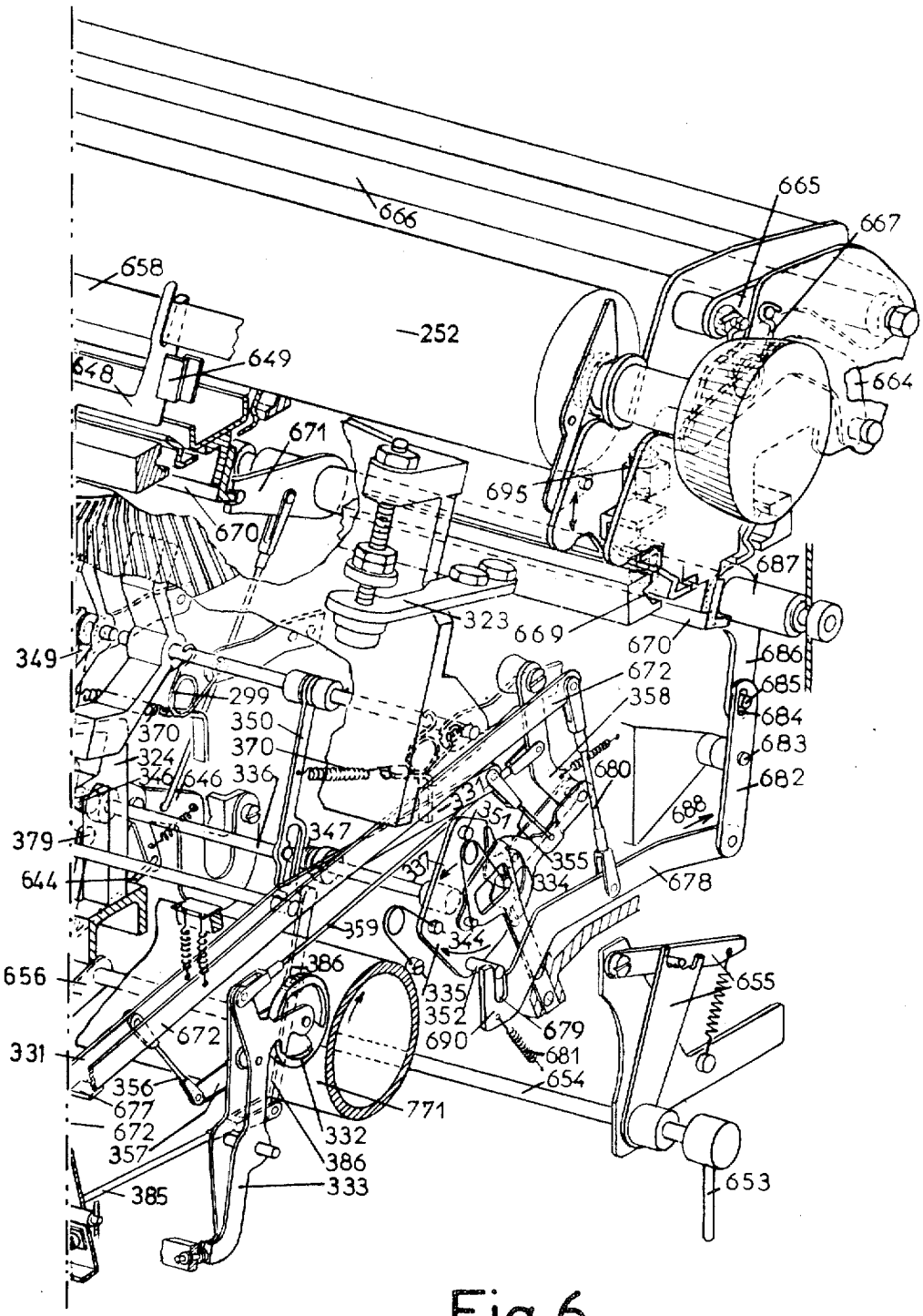

The three connecting-pieces 348, 349 350 have the shape shown in FIGS. 6 and 8. Each presents a trefoil-shaped hole. In the forward part of this hole the pin of the corresponding wrist-pin lever is engaged. But if the connecting-piece is made to pivot in the direction of the arrow 353, the pin of the wrist-pin lever becomes disconnected from the forward part of the hole 354; and if the wrist-pin lever then pivots downwards, its pin slips into the prolongation of the cavity without pulling the connecting-piece with it. The corresponding basket is then disconnected.

The descent into the 2nd case Position of the basket of Group I. alone

The depression of the key "2eI" makes the reversed lever 371 (FIG. 6) pivot. The latter, through the catch-pin 373 at its end, pivots the lever 374, a stirrup 375 and a lever 376 as a rigid assemblage which moves freely on a shaft 381. The lever 376, by a connecting-rod 377, causes a lever 379 to pivot. The latter, through its upper end, makes the connecting-piece 349 pivot, which disconnects basket II.

At the same time, the catch-pin 373 presses on a lever 382 and thus causes a second rigid assemblage, made up of the shaft 381 and the levers 382, 383 and 384, to pivot. The lever 384, through a connecting-rod 385, causes a lever 386 to pivot. The upper end of the latter presses on the connecting-piece 350 and makes it pivot, which disconnects the basket III-IV-V.

At the same time, the reversed lever 371, by a second catch-pin 387, makes the lever 364 pivot, which through the shaft 362, operates the longitudinal lever 331, which, in a continuation of the movement, engages cam 332 on the driving cylinder. It follows that the shaft 336 and the wrist-pin lever 345 pivot and the latter makes basket I descend into the 2nd case position. The two other baskets, having been disconnected, do not descend.

When the key "2eI" (2nd I) is released, all the parts that it had displaced return to their rest position and the driving device causes basket I to reascend. Return springs, such as 370, reconnect the connecting-pieces 349 and 350.

The descent into the 2nd case Position of Basket II alone

The depression of key "2eII" (2nd II) causes the reversed lever 372 to pivot. The latter, through the catch-pin 388 borne by its extremity, causes the lever 383 to pivot, which, by means of the shaft 381 and the lever 384, disconnects the basket III-IV-V as in the preceding case. At the same time, the catch-pin 388 acts on the lever 389 and causes the ensemble consisting of this lever, the stirrup 390 and the lever 391, to pivot. This last, by a connecting-rod 392, causes the lever 378 to pivot, which disconnects basket I.

At the same time, the reversed lever 372, by a second catch-pin 393, makes the lever 365 pivot, which, through the shaft 362 and the lever 366, engage in the course of the movement the cam 332 on the driving cylinder 771. This produces, as in the preceding cases, the pivoting of the driving shaft 336 and of the wrist-pin lever 346. The latter causes basket II, which has not been disconnected, to descend into the 2nd case position.

When the key is released, the movements occur in the reverse directions and basket II returns to the 1st case position. Return springs, such as 370, reconnect baskets I and III-IV-V.

Description of the vertically mobile part of the carriage

The carriage (FIGS. 6, 7 and 8) comprises a vertically mobile device simimlar to that used in certain conventional typewriters which have only a fixed type-bar basket. This device consists mainly of the carriage cylinder 252 which bears the paper (platen), the paper-guides being of the usual type such as metal sheets and rollers, not shown. This device is fixed on to two identical articulated parallelograms, each comprising two connecting-rods, shown from the side partially in dotted lines that is the connecting-rods 662 and 663 at the left, 664 and 665 at the right. The upper connecting-rods 663 and 665 make up, together with a common shaft 666, a rigid, pivoting assemblage that ensures simultaneous movement both left and right. The shaft 666 together with the connecting-rods 662 and 665 pivot on the part of the carriage that does not ascend. The weight of the vertically mobile device is compensated for by springs that are not shown in the drawing (for example, around the shaft 666).

The bottom position and the top position are stabilised by two identical hairpin shaped springs 667 and 668 shown in dotted lines.

A rail 670, situated between the teeth of a fork 671, is fixed on the lower part 669 of the vertically mobile device. This rail moves laterally with the carriage. It is the fork which, in pivoting, makes the mobile device, which bears the cylinder 252, move from its bottom to its top position and vice versa. Vertical displacement is limited downwards and upwards by adjustable stops such as 695 to the right and 691 to the left.

Description of the device that causes the vertical displacement of the vertically mobile part of the carriage There is a longitudinal lever 672, bearing a catch-pin 673, parallel to the longitudinal lever 331 (FIG. 6).

The key "Tout 3e" (All groups in third case position) is fixed to a parallelogram whose lower connecting-rod 674 is fixed to an axle 675 that carries a reversed lever 676. The latter presses on the catch-pin 673 and thus causes the pivoting of the lever 672. The lever 331 bears a tongue 677 over which the lever 672 passes.

The lower catch-pin 352, borne by the plate 335, is longer than the upper catch-pin 351. An engageable connecting-rod 678 transmits the movement of the catch-pin 352 in the direction of the arrow 688 when this connecting-rod is engaged on the catch-pin. In the rest position it is disengaged. It presents a notch 679 by which it can be interlocked with the catch-pin 352. This connecting-rod is suspended from the lever 672 by a connecting-rod 680. A return-spring 681 pulls on the connecting-rod 678. The latter is mounted to pivot on a reversing-lever 682 whose axle 683 is fixed to the framework. The upper end of the lever 682 presents an elongate hole 684 in which a catch-pin 685 is engaged. This catch-pin is fixed on a lever 686. The latter is fixed on a shaft 687. It is on this shaft that the fork 671, which controls the ascent and descent of the vertically mobile part of the carriage, is also fixed. The angular displacements of the rigid assemblage made up of the lever 686, the shaft 687 and the fork 671 are limited by adjustable stops not shown in the drawing. These two extreme positions are maintained by two hairpin shaped spring 667 and 668 shown in dotted lines in FIGS. 6, 7 and 8.

Running

Each depression of the key "Tout 3e" (All 3rd) effects, by means of the reversed lever 676, the downward pivoting of the lever 672 on the axle 745. This lever, through the connecting-rod 680, makes the connecting-rod 678 pivot upwards against the pull of the spring 681, which engages this connecting-rod on the catch-pin 352 by means of the notch 679. The lever 672, pressing on the tongue 677, makes the lever 331 pivot that, in the course of its movement, engages the cam 332 on the driving cylinder 771. This engagement produces the pivoting of the plate 335 in the direction of the arrow 337 and the descent of the three baskets, just as when the key "Tout 2e" (All 2nd) is depressed. But, in addition, the catch-pin 352 pushes the connecting-rod 678 in the direction of the arrow 688, which causes the lever 682 to pivot, as well as the assemblage made up of the lever 686, the shaft 687 and the fork 671. The latter lifts up the rail 670, which causes the vertically mobile part of the carriage that carries the cylinder 252 to ascend.

Thus, the three baskets having descended into the 2nd position and the carriage cylinder having correspondingly ascended, the carriage cylinder is in the 3rd case position in relation to all the type-bars, which allows the printing of the characters of the 3rd case (figures and various signs).

Each depression of the key "Bloc 3e" produces the same effect; but, in addition, locks the lever 672 in the lower position by the well-known means of a locking-hook 689. This locking is used when many figures are to be printed.

When the key "Tout 3e" (All 3rd) is released, all the displaced parts return automatically to their rest position. In particular, the connecting-rod 678 pivots downward, the catch-pin 352 comes out of the notch 679, which disengages the connecting-rod; but the catch-pin 352 continues to push the front end 690 of the connecting-rod, which has been lengthened for this purpose.

A three-position basket combined with a carriage whose cylinder can occupy two positions will be described below. This will permit the use of four characters per type-bar, which is advantageous in machines built for work requiring a large number of special characters.

It has not seemed useful to show this combined use of two mechanisms that have already been shown separately, in the drawings.

Mechanism for raising the ribbon

The mechanism for advancing the ribbon has not been described because it is identical with that used in ordinary typewriters. It is actuated by the levers 280, 278 and 279 FIGS. 5, 10, 11 and 14.

On the contrary, the means used to reach the 3rd case position (means that consist of combining the descent of the baskets with the ascent of the carriage cylinder) requires the employment of a mechanism for raising the ribbon designed in such a way that the ribbon support moves vertically at the same time as the carriage cylinder.

Figure 7:
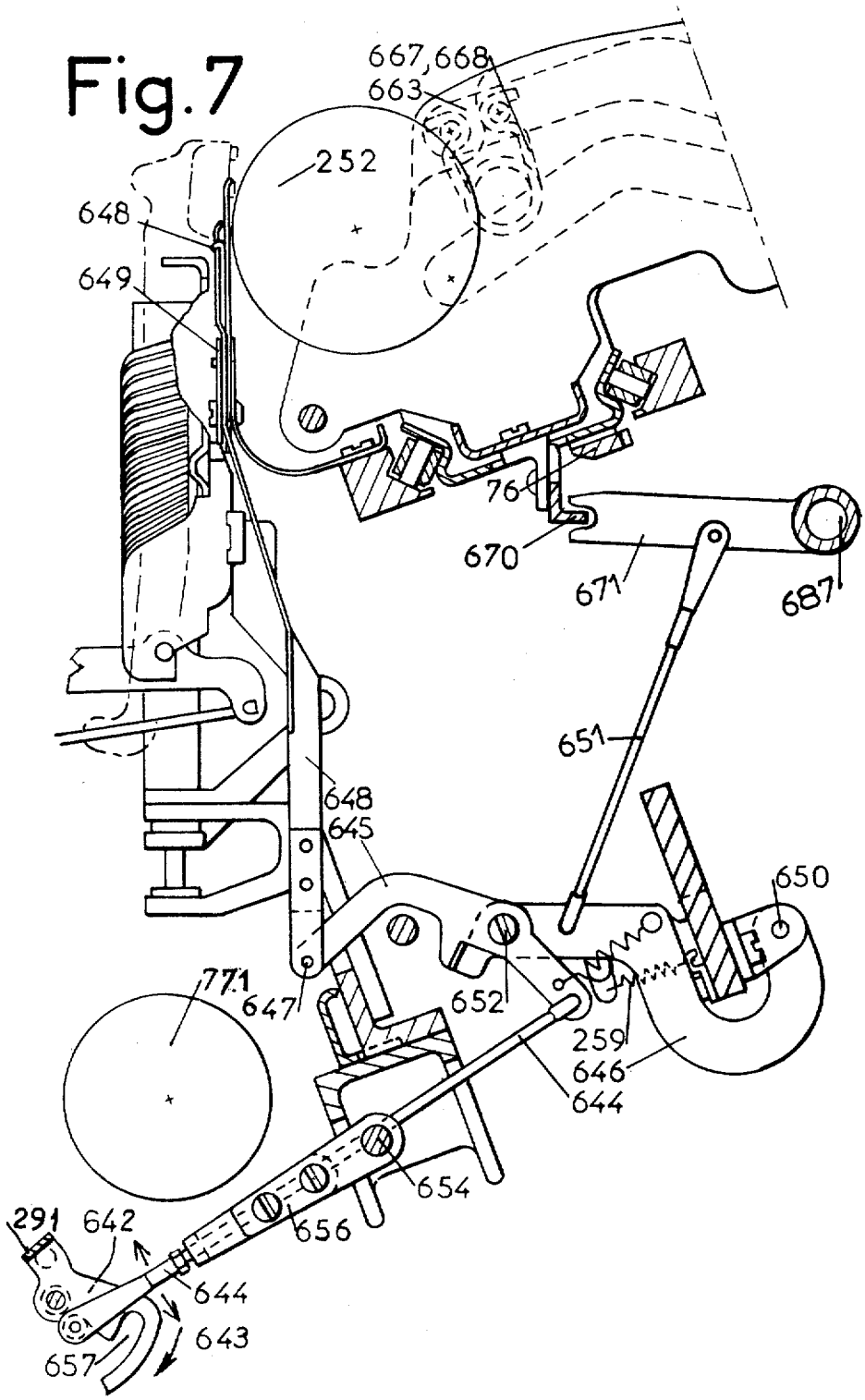
FIG. 7. Mechanism for raising the ribbon, the vertical displacements of which are controlled by the vertical displacements of the carriage cylinder. View from the right.

The lower end such as 692 of the intermediary levers 772 (FIGS. 8 and 5) of each group causes a paddle or escapement-bars to pivot : from 271 for goup I, to 275 for group V (FIGS. 10 to 23). These group escapement-bars all pull the same stirrup 291 (FIGS. 22 and 23) that bears the lever 642 (FIGS. 6 and 7). During each printing action, this lever thus pivots in the direction of the arrow 643. It draws on a connecting-rod 644 by which it causes a lever 645 to pivot. This latter pivots on an axle 652 fixed to a pivoting support 646. The other end of the lever 645 bears an axle 647 on which is mounted the lower end of the fork 648 that supports the ribbon 658 (FIG. 6). The upper part of this fork slides in two guides 649.

The pivoting support 646 (FIG. 7) is articulated on an axle 650 fixed to the framework. On the other hand, through a connecting-rod 651, it is interconnected with the fork 671 that displaces vertically the mobile part of the carriage. Thus when the fork 671 pivots upwards (3rd position), it causes the support 646 to pivot in the same direction, which displaces the axle 652 upwards. As a result the position of the fork 648 is displaced upwards and its movements, at each printing, bring the ribbon beneath the character of the 3rd case.

A change of amplitude of the movements of the fork 648, or the suppression of these movements for cutting stencils is controlled by a device consisting of a hand lever 653 (FIG. 6) fixed to a shaft 654, and a device with toothed sector 655, which immobilises the shaft 654 in its various positions. The shaft 654 bears a lever 656 (FIG. 7) whose length is adjustable and in whose end slides the connecting-rod 644.

In making the whole assembly pivot, the front end of the connecting-rod 644 is made to ascend or descend, and the amplitude of the movements transmitted to this connecting-rod by the lever 642 is thus modified, which changes the area of the ribbon and if necessary the colour, on which the characters strike. When the connecting-rod is brought down into the lowest position, the end of this connecting-rod is in front of the notch 657 in the lever 642. In this case, the connecting-rod is no longer being pulled and the ribbon does not rise.

Thin-sheets situated between the consecutive type bar groups

In syllabic typewriters comprising sectors which correspond respectively to different type bar groups and in which moreover the case position can be changed for certain sectors independently of the position of the other sectors, the problem of type bar guides between the successive type bar groups and the problem of sustaining the cushions 627, 637, 638 (FIG. 5) for the type bars have to be resolved. It is also necessary to avoid collisions between type bars belonging respectively to two contiguous type bar groups and which are utilized simultaneously.

In the embodiment described here, as in a second embodiment shown in FIG. 33 and described below, these three problems are resolved together by the same parts which consist of thin sheets 625, 630, 631, 633, 634 and 635 (FIGS. 5, 25 and 33).

When two consecutive groups can be displaced only together for case shift, there is between them one thin sheet only. This is the case between groups III and IV, and between the groups IV and V.

When two consecutive groups may be displaced each separately, there are two thin sheets between them. This is the case between the first and the second group and between the second and the third group.

The type-bar guide 621 (FIG. 5) to the left of Group I is similar to the left-hand half of the type-bar guides used in nonsyllabic typewriters. It consitutes the upper end of the part 623 that comprises the ring 624 of group I. The type-bar guide 622 to the right of group V is symetrical with the type-bar guide 621 and is also similar to that of a non-syllabic typewriter.

To the right of group I, the thin sheet 625 is fixed at its back to the part 623. The support 626 for the cushion 627 for the type-bars of group I is fixed at the left to the frame 629 (FIG. 8) of basket I by a screw 628, and at the right to the thin sheet 625 (FIG. 5) folded for this purpose. This thin sheet 635 is solid with the selector 301 of group I. Two similar thin sheets 630 to the left and 631 to the right of group II are fixed at their back to the sector 302 (FIG. 25) of group II. The support 632 (FIG. 5) for the cushion 637 for the type-bars of group II is fixed on the front part of these two thin sheets, folded for this purpose.

The thin sheet 633 situated at the left of group III, the thin sheet 634 situated between group III and group IV, the thin sheet 635 situated between group IV and group V are all similar to those described for groups I and II. At their front, they are each fixed on and support the support 636 for the cushion 638 which is common to groups III, IV and V. Each thin sheet may be lightened by a hole, as shown in FIGS. 5 and 33.

The thin sheets do not prevent the displacement of the baskets into the 2nd case position.

Each thin sheet is situated between the path of movement of the type bars corresponding to two successive type-bar groups.

The shift mechanism comprising three-position "baskets"

Comparison with the mechanism anteriorly described

In the first embodiment already described, the sectors that 5 bear the type bars can be put in two different case positions and their descent is combined with the rise of the carriage cylinder to enable printing of the characters of the 3rd case.

The mechanism of which a description follows enables the positioning of the sectors in three different positions, which enables either the use of a carriage whose carriage cylinder is not displaced vertically, yet with three characters per type bar, or the combining of the availability of three sector positions with vertical displacements of the carriage cylinder, in order to equip the type bars with four characters one above the other.

In the figures, each type bar bears three characters and the carriage cylinder is not shifted vertically.

In the example, the mechanism comprises three independent "baskets" as in the first embodiment. The shifting possibilities have been thus kept, that is to say : shift down to the 2nd case position (capitals) either sector I alone or sector II alone, or all the sectors. But in addition the mechanism enables all the sectors to be raised to a third case position (digits and signs). The first position (small letters) is thus the middle position.

The part of a well known shift driving mechanism already used for the first embodiment and shown in FIG. 6 is also used here. The additions that had been made in this first embodiment to move the carriage up (longitudinal lever 672, its connection 680, the engageable connecting rod 678, and all the other parts that transmit this movement to the carrriage cylinder) are eliminated in the present embodiment, but will be kept when four characters per type bar and four case positions are used.

The well known shift driving mechanism is kept from the motor up to the shaft 336 inclusive, which in ordinary electric typewriters and also in the first embodiment described above brings the sectors down into the 2nd case position and then raises them back into the 1st case position.

To get the mechanism to operate with the same movements up and down, for the first and second case positions, as in the first embodiment and in addition to provide that it makes all sectors rise into a 3rd case position, and returns them to the 1st case position, this mechanism is completed with elements which will now be described.

As in the first embodiment, the sectors of groups III, IV, V, 303, 304, 305, (FIG. 5) are fixed on a common frame 601 FIGS. 24 to 28, to constitute the "basket" III-IV-V.

Description of the basket of group I

The basket I is similar to that used in the first embodiment (FIGS. 5 and 8). It comprises similarly : a frame 607 (FIG. 25) on which is fixed the sector 301 and, fixed to this assemblage, a part 621 of type-bar guide at the left of group I, a thin sheet 625 at the right of group I (FIG. 5) and also the cushion support 626 which supports the cushion 627 not modified. But the four flexible blades such as 203 and 204 FIG. 8, through which the basket I was linked with the frame of the machine are replaced by rods 608, 609, 610 (FIG. 25) fixed on the frame 607. These rods slide in holes 611, 612, 613 (FIGS. 24 and 26) bored in the frame 601 (FIGS. 24 to 28). The basket I is thus mobile on the basket III-IV-V and can be shifted down separately from the first case position (small letters) to the second case position (capitals).

Description of the basket of group II

Basket II (FIG. 25) is similar to the basket II used in the first embodiment (FIG. 5). It comprises the frame 614 (FIG. 25) which is slightly different, the sector 302, the thin sheets 302, the thin sheets 630 and 631 (FIG. 5), the cushion 637 and its support 632. But rods 615, 616 and 617 (FIGS. 25 and 26) fixed to the frame 614 (FIG. 25) replace the two flexible blades identical to the blades 203 and 204 (FIG. 8) which linked the basket II to the frame of the machine. These three rods slide in holes 618, 619, 620 of the frame 601 of basket III-IV-V (FIGS. 24 and 25). The basket II is thus movable on the basket III-IV-V and can be shifted down separately from the lst case position (small letters) to the 2nd case position (capitals).

Description of the general basket.

In short, the frame 601 on which are fixed sectors III, IV, V constitutes the frame of a general basket within which baskets I and II are mobile.

The frame 601 (FIGS. 24 to 28) has holes 846 to 849 which enable it to slide on the rods 850 to 853 fixed to the frame of the machine through supports 844 and 845. The frame 601 thus slides downwards to place into the 2nd case position (capitals) or moves upwards to place into the 3rd case position (digits and signs) the three baskets as a whole.

Description of the mechanism which transmits the movements to the general basket The driving shaft 336, by the pivoting given it by the well known driving mechanism partially shown in FIG. 6 and described above can shift the general basket into the three case positions.

The shaft 336 pivots on the frame of the machine as in the first embodiment (FIG. 6) where it drives the two-shift position baskets. It bears at its right extremity the plate 335 by which the well-known mechanism makes it pivot, at first in the direction of the arrow 337, then back in the direction of the arrow 344 (FIG. 27). The plate 335 (FIG. 6) and consequently the shaft 336 are pushed towards one or the other of the two case positions and held there by a bistable spring 841 (FIG. 28) pivoting on the frame 715 and on one of the levers 855 that the shaft 336 bears at the right and by an identical spring 360 pivoting on the frame 715 and on a lever 84 (FIG. 27) that the shaft 336 bears at the left. The two levers 854, 855 are extended in front of the shaft 336 and each has a slot 856, 857. The frame 601 (FIGS. 24 to 28) has holes 858 to the left and 859 to the right in which sldes a cross-bar 808 (FIGS. 25 and 26). This cross-bar bears an arm 809 equipped with two catch-pins 810, 811 and another identical arm 812 equipped with two catch-pins 813, 814. These catch-pins enable engagement to drive the general basket into 2nd or 3rd case position. The cross-bar 808 bears at each end a double catch-pin 815 at the left and 816 at the right. The left end of this cross-bar is located on the inside of a part 817 fixed on the frame of the machine and with which it constitutes a device to lock the general "basket" in 1st case position (small letters). The right end of the cross-bar 808 constitutes with the part 818 a device similar to that at the left. The part 817 comprises two identical flat parts 866 and 867. The end of the sliding cross-bar 808 is between these two flat parts. Each of these parts 866 and 867 presents a curved slot 868 in which one end of the double catch-pin 815 borne by the cross-bar is located. At rest the catch-pin is in the middle of the horizontal part of the slot. The edges of this slot prevent the catch-pin from rising or going down, thus locking the cross-bar 808 and the general basket into the 1st case position (small letters). When the cross-bar is moved to the right, the double catch-pin can descent into the vertical part at the right of the slot, thus allowing the general basket to descent into the 2nd case position (capitals). When the cross-bar is moved to the left, the double catch-pin can rise in the vertical part at the left of the slot, thus allowing the general basket to reach the 3rd case position (digits and signs) The locking device located at the right end of the cross-bar 808 works in the same way and at the same time. The displacements to the right and left of the cross-bar 808 and its return to rest position are obtained by means of a device comprising the following parts: a lever with three arms 894, 895, 896, this lever being freely mounted on a shaft 897, an elecromagnet 898 with a fixed core which can attract the arm 894, a second identical electromagnet 899 which can attract the arm 895, the end of the arm 896 being located between two projections 908 and 909 on the crossbar 808, an elastic double-effect device comprising: a connecting rod 910 freely mounted on a shaft 911 which the arm 894 of the lever with three arms bears at its end, a spring 912 placed round the connecting rod 910 as well as two washers 913 and 914 which can slide on this connecting rod; two washers 915 and 916 which, after the placing of the spring and of the washers 913, 914, are pinned on the connecting rod, a double support 918 in the end of which the washers 915 and 916 can slide. The cross-bar 808 has a finger 891 located between the two levers of two micro-switches 900 and 919.

The device just described enables, in moving the cross-bar 808 to the right, the introducing of the catch-pin 811 in the hole 856 of the leve 854 (FIG. 27), and the introducing of the catch pin 814 (FIG. 25) in the hole 857 of the lever 855 (FIG. 28), thus linking the general basket with levers 854 and 855 on shaft 336, in order that this basket be shifted down to the 2nd case position and then up to the 1st case position, as the single basket does on an ordinary typewriter.

The supplementary parts described hereafter have as an aim to effect the reverse movements so that the general basket can be moved up to the 3rd case position (digits and signs) and then back to 1st the case position.

A shaft 869 (FIGS. 25 to 28) is fixed on a support 844, itself fixed on the left side of the frame 715 of the machine. On this shaft a plate 870, which has a hole 871 located facing the catchpin 810, oscillates. A shaft 872 is fixed on a support 845, itself fixed on the right side of the frame 715 of the machine. It is aligned with the shaft 869. On the shaft 872 a plate 873 oscillates. It is identical to the plate 870. The plate 873 has a hole 874 facing the catch-pin 813. The shaft 336 also bears at the left a wrist-pin lever 879 bearing a pin 880 which is received in a notch 881 of plate 870. The plate 870 is thus connected to the shaft 336. When the shaft 336 and the wrist-pin lever 879 pivot in one direction, the plate 870 pivots in the opposite direction. The shaft 336 at the right, a wrist-pin lever 860 which is identical to the wrist-pin lever 879 and which connects the shaft 336 with the plate 873, thus making the plae 873 pivot in the opposite direction to the movement of the shaft 336.

Stops of known type 321 and 323 limit the descent of the frame 601 of the general basket into the 2nd case position and its rise into the 3rd case position.

The frame 601 bears a catch-pin 819 and another catch-pin 882 (FIGS. 25 and 28). In the descent path of the catch-pin 819 is situated the lever of a micro-switch 838. The latter is fixed on the frame 715 of the machine. This micro-switch cuts off the circuit of the electromagnet 898 (FIG. 26) when the general basket arrives in the 2nd case position. In the rising-path of the catch-pin 882 (FIGS. 25 and 28) is situated the lever of a micro-switch 920 also fixed on the frame 715 and which cuts off the circuit of the electromagnet 899 (FIG. 26) when the general basket arrives in the 3rd case position.

The shift keys tht control the mechanism described here have the same designations as those in the keyboard shown in FIGS. 1 and 6.

However in the present embodiment, each of these shift keys can constitute the push-button of a switch (FIGS. 31, 32 and 33) which closes the circuit of an electromagnet. Thus, the whole of the levers and other mechanical connections that are controlled by the shift keys shown in FIG. 6 are suppressed and replaced by electrical lines. The lever 331 (FIGS. 6 and 28) which controls the engagement of the cam 332 by the connection 356 and that controls the plate 337 by the connection 355 remains, but the lever 331 is controlled by an electromagnet 884 (FIG. 28).

Thus, the shift keys in question can be used, either in a keyboard of the type shown in FIG. 1, or in a keyboard of the type shown in FIGS. 31 and 32. These are the keys: Tout 2e (All 2nd), Blocage Tout 2e (Bolt All 2nd), 2eI (2nd I), 2eII (2nd II), Tout 3e (All 3rd), Blocage tout 3e (Bolt All in 3rd).

The descent of the general basket into 2nd case position (capitals)

The descent of the key "Tout 2e" (All 2nd) (FIG. 31) closes the circuit of the electromagnet 898 (FIG. 26). This attracts the arm 894 of the three-armed lever, whose arm 896 pushes the projection 909 of the cross-bar 808 and thus makes this cross-bar slide to the right. Thus, the double catch-pins 815 and 816 each come above the descending parts of the curved slots wherein are located its ends within the locking parts 817,818 FIG. 25). The connecting rod 910 (FIG. 16), by means of the pinned washer 915 and by the sliding washer 913, compresses the spring 912 against the sliding washer 914 while the pinned washers 915 and 916 slide in the double support 918.

The catch-pin 811 (FIGS. 25 and 27) enters into the hole 856 of the lever 854 and the catch-pin 814 (FIGS. 25 and 28) enters into the hole 857 of the lever 855. Thus the general basket is connected with the shaft 336 at the left and at the right.

At the end of the movement, the protuberance 891 (FIG. 26) of the cross-bar 808 pushes the lever of the microswitch 900. This closes the circuit of the electromagnet 884 (FIG. 28) whose core attracts the lever 331 (FIGS. 6 and 28) thus engaging the cam 332 on the driving cylinder 771, as it is well known. The driving of the shaft 336 is the same as in the mechanical solution (FIG. 6) and as in ordinary non-syllabic typewriter. The shaft 336 (FIG. 27) pivots in the direction of the arrow 337 and the levers 854 and 855 (FIG. 25) draw the general basket downwards with all the sectors. Each of te catch-pins 815 and 816 therefore descends into the right part of the slots in which they are situated. One can then type characters of the 2nd case in all the groups. The keyboard includes a lock-key which duplicates the key "Tout 2e" (All 2nd) and locks the general basket in low position. The machine includes a pedal 936, (scheme FIG. 29) which is equipped with a switch and which has the same function as the key "Tout 2e" (All 2nd). This enables the typist to obtain and to maintain the 2nd case position with his foot and thus leave both hands free for the typing of one or more words in capital letters, without recourse to the lock-key for the 2nd case position. During the course of such typing and so long as the key "Tout 2e" (All 2nd) or the pedal 936 which duplicates it, is depressed, the electromagnet 884 switched on by the protruberance 891 (FIGS. 26, 28 and 29) and by the micro-switch 900 remains switched on, thus maintaining the lever 331 depressed, as in an ordinary typewriter. This electromagnet is, for this purpose, wired in an AND circuit so that switching it "on" necessitates the closing of the circuit by the micro-switch 900 and by the key or the pedal.

When the key or the pedal is released, the circuit of the electromagnet 884 is thus cut off, although the protuberance 891 still engages the lever of the micro-switch 900. The lever 331 (FIGS. 6 and 28) thus rises back and, as in the first embodiment or in an ordinary typewriter, the cam 332 is engaged again on the driving cylinder 771. The axle 336 pivots in the direction of the arrow 344 and the general basket rises back with the cross-bar 808 (FIGS. 25 and 26) and with the catch-pins 815 and 816. The frame 601 (FIGS. 25, 26 28 and 29) when descending, had by the catch-pin 819, pushed the lever of the micro-switch 838 which had cut off the circuit of the electromagnet 898. When the frame 601 rises back, the finger 819 releases the lever of the micro-switch 838 which recloses the circuit at this point, but as the key "Tout 2e", or the pedal which duplicates it, being is up again, the circuit of the electromagnet 898 remains cut off. This electromagnet no longer attracts the arm 894 of the three-armed lever. The return spring 912 cannot bring the cross-bar 808 back to its rest position because the two double catch-pins 815 and 816 are in the vertical descending parts of the holes 868. As soon as these double catch-pins are raised again to the level of the horizontal section of the slots, they can no longer resist the action of the spring 912 and this brings the cross-bar back into its rest position. The general basket is thus once again disengaged and locked at the level of the first case position (small letters). The rounded form to the changes of direction of the holes 868 in which each catch-pin is located helps to change the direction of movement of the catch-pin and consequently also of the cross-bar 808 a little before the level of locking.

Shifting of the general basket into 3rd case position (figures and signs)

The key "Tout 3e" (All 3rd) (FIG. 31) is duplicated by a lockkey locked in low position as for keys in shift position on conventional typewriters. The key "Tout 3e" (All 3rd) closes the circuit of the electromagnet 899 (FIG. 26). This key is duplicated by a pedal 937 (FIG. 29) which is equipped with a switch and which has the same effect as the key. When the key or the pedal is depressed, the fixed core of the electromagnet 899 attracts the arms 895 of the three-armed lever whose arm 896 pushes the projection 908 to the left, which displaces the sliding cross-bar 808 in that direction. Each of the double catch-pins 815 and 816 is thus brought beneath the rising part of the slot 868 within which it is situated (FIGS. 25 and 29). The arms 809 and 912 borne by the cross-bar 808 moves together with it, and the catch-pins 810 and 813 move into the corresponding holes. The general basket is thus linked with the pivoting plates 870 and 873 whose oscillations are produced by those of the shaft 336, but occur in the reverse direction to that of this shaft.

The continuation of the process is the same as when one makes the general basket descent into 2nd case position, by the key "Tout 2e" (All 2nd), but the plates 870 and 873 cause the frame 601 to rise to the 3rd case position instead of making it go down. The frame 601, during the end of its ascent pushes, by the finger 882, the lever of the micro-switch 920. This cuts off the circuit of the electromagnet 899 (FIGS. 26 and 29). When the frame 601 redescends, it releases the lever of the micro-switch 920, which recloses the circuit at this point, but the key "Tout 3e" (All 3rd) or the pedal which duplicates it, being raised again the circuit of the electromagnet 899 remains cut off. This electromagnet no longer draws the arm 895 of the three-armed lever. The return spring 912 cannot the cross-bar 808 back to it rest position because the two double catch-pins 815 and 816 are in the vertical rising part of the slots. As soon as these catch-pins redescend to the level of the horizontal part of the slots, they no longer resist the action of the spring 912 and this brings the cross-bar back to its rest position. The general basket is thus once again disengaged and locked at the level of the 1st case position (small letters).

Mechanisms allowing descent of the basket of group I along into the 2nd case position (capitals)

Description. It has been explained that the basket of group I could slide on the frame 601 of the general basket in order to descend from 1st to 2nd case position. The frame 601 then remains locked in 1st case position. A wrist-pin lever 888 (FIGS. 25, 26, 33 and 29) is fixed on the shaft 336. The frame 607 of the basket I bears a shaft 886 on which is mounted a connecting engageable rod 885 which has a notch 887 placed in front of a pin 889 that the wris-pin lever 888 bears. In the rest position the connecting rod 885 is held by a return spring 890 so as the pin 889 is outside of the notch 887. In this situation the basket I is thus not brought down by the pivoting of the shaft 336. If the frame 601 of the general basket rises to the 3rd case position, it takes with it the frame 607 of the basket I. The pin 889 does not prevent this.

The connecting rod 885 includes a catch-pin 843 (FIGS. 33 and 34) which, in rest position, is situtated on the edge of the frame 601; this locks the frame 607 of the basket I onto the general basket. When the connecting rod 885 has pivoted in order to be engaged on the pin 889, the catch-pin 843 is no longer above the edge of the frame 601; the basket I is thus unlocked and can descend, but the catch-pin 843 then descends behind the frame 601. During the descent, it thus prevents the connecting rod 885 from desengaging from the pin 889 when the typist releases the key "2eI".

The connecting rod 885 includes a wing 842 (FIGS. 26, 33 and 29). Behind this wing there is a fixed-core electromagnet 907. This electromagnet is fixed on the frame 715 of the machine through a support 820. In the path of movement of the lower end of the connecting rod 885 is situated the lever of a microswitch 893 which connects the electromagnet 884 (FIGS. 28 and 29).

The key "2eI" (2nd I) is optionally duplicated by a pedal 938 represented schematically (FIG. 29). This pedal is equipped with a switch and its depression has the same effect as the depression of key "2eI" (2nd I).

The electromagnet 884 serves to engage the cam 332 on the driving cylinder, not only to assure the descent and ascent of the basket I along, but also to assure the descent and ascent of basket II alone and that of the general basket. For this reason the electromagnet 884 is controlled by three separate circuits: one for the movements of the general basket, one for the movements of basket II, and one for the movements of basket I. This last circuits is of the AND type. It comprises two switches. One of these is controlled by the descent of the key "2eI" (2nd I) (or of the pedal which duplicates it) and the other by the micro-contact 893 which the connecting rod 885 controls.

Working

The depression of the key "2eI" (2nd I) or of the pedal 938 closes at this point the circuit of the electromagnet 907 (FIGS. 26, 29 and 33). This attracts the wing 842 of the connecting rod 885. The pivoting of the connecting rod engages it on the pin 889 and cancels the locking ensures by the catch-pin 843 on the frame 601. The lower end of the connecting rod 885 pushes the lever of the micro-switch 893. This closes the circuit of the electomagnet 884 which attracts the lever 331 (FIGS. 6 and 28). This engages the cam 332 on the driving cylinder 771 and causes the shaft 336 (FIG. 33) to pivot in the direction of the arrow 337. The pin 889 of the wrist-pin lever 888 pulls downwards the connecting rod 885 and this brings the basket I into the 2nd case position.

When the typist releases the key "2eI" (2nd I) or the pedal 938, the circuit of the electromagnet 884 is cut off and this no longer attracts the lever 331. This lever rises again, which reengages the cam 332 that causes the shaft 336 to pivot in the direction of the arrow 344 (FIG. 28) and causes the basket I to go up again to its 1st cast position.

Device causing the movements of basket II alone.

The device which causes the descent of the basket of group II along into its 2nd case position and then its return to its 1st case position is identical with the device that controls the basket of group I and its profile is shown in FIG. 33. FIGS. 25 and 26 locate it in a front view and in a top view showing its connecting rod 840 which is identical with the connecting rod 885 and which is controlled by a wrist-pin lever 839 (FIG. 29) identical with the wrist-pin lever 888.

In the embodiment where the machine is equipped with a switch keyboard (FIG. 21 or 32) the key "2eII" (2nd II) is also optionally duplicated by a pedal 939 (FIG. 29).

The electro-mechanic scheme of FIG. 29 shows the whole of the electrical circuits, of the switches and also of the electromagnets which causes the case position shifting of the three baskets.

FIG. 30 shows the sequence of the effects produced by each of the keys that cause a case position shifting or by the pedal which duplicates this key.

I claim:

1. A syllabic keyboard controlled device comprising: a motor, a driving cylinder (771 FIG. 6) coupled with and driven by said motor, a plurality of type bars arranged in groups each of which corresponds to a distinct printing point (FIG. 5*a*, 5*b*), each of said type bars having characters arranged thereon in three levels or cases, a first basket supporting a first group of said type bars, means mounting said first basket to permits its displacement downwards (FIGS. 5 and 6), a second basket supporting a second group of said type bars, means mounting said second basket for displacement downwards, a third basket supporting a third group of said type bars, means mounting said third basket for displacement downwards simultaneously with the displacement of said first basket and said second basket, a carriage cylinder, means including a plurality of levers (662–665, FIGs. 6 and 8) mounting said carriage cylinder for displacement upwards in combination with displacement of said baskets downwards, shift means for effecting selected vertical displacement of said baskets and said carriage cylinder, said shift means comprising first, second, third and fourth shift keys, a driving shaft, means for connecting said driving shaft with and disconnecting it from said driving cylinder, wrist pin levers carried by said driving shaft and releasably engageable with said baskets, means actuatable by said first shift key for disengaging said second and third baskets from said wrist pin levers and coupling said driving shaft with said driving cylinder to displace only said first basket downwards, means actuatable by said second shift key for disengaging said first and third baskets from said wrist pin levers and then coupling said driving shaft with said driving cylinder to displace only said second basket downwards, means actuatable by said third shift key for connecting said driving shaft with said driving cylinder, with none of said baskets disengaged from said wrist pin levers, to displace said first, second and third baskets downwards simultaneously, and means actuatable by said fourth shift key for connecting said driving shaft with said driving cylinder, with none of said baskets disengaged from said wrist pin levers, and additionally for connecting said driving cylinder with said levers of said carriage cylinder mounting means to displace said first, second and third baskets downwards and simultaneously to displace said carriage cylinder upwards.

2. A syllabic keyboard controlled device comprising a fixed framework, a motor mounted on said framework, a driving cylinder coupled with and driven by said motor, a plurality of type bars arranged in groups each of which corresponds to a distinct printing point (FIG. 5*a*, 5*b*), each of said type bars having characters arranged thereon in three levels or cases namely a lower case, an upper case and a middle case disposed between said lower case and upper case, a first basket supporting a first group of said type bars, a second basket supporting a second group of said type bars, a third basket supporting a third group of said type bars, means slidably mounting said third basket on said fixed framework for movement from an intermediate rest position for printing middle case characters down to a second position for printing upper case characters and up to a third position for printing lower case characters, means for releasably locking said third basket to said fixed framework in rest position, means for slidably supporting said first and second baskets on said thrid basket for movement relative to said third basket from an intermediate rest position for printing middle case characters down to a second position for printing upper case characters and up to a third position for printing lower case characters, and means for shifting said baskets comprising first, second, and third and fourth shift keys, a first driving shaft, means for releasably coupling said driving shaft with said driving cylinder to rotate said driving shaft, lever means carried by said driving shaft and releasably engageable with said baskets to move said baskets downwards, a second driving shaft permanently connected with said first driving shaft so as to turn in the opposite direction thereto, lever means on said second driving shaft and releasably engageable with said third basket to move said third basket upwards, means actuatable by said first shift key for engaging said lever means of said first driving shaft with said first basket and then coupling said first driving shaft with said driving cylinder to move said first basket alone from said rest position down to said second position, means actuatable by said second shift key for engaging said lever means of said first driving shaft with said second basket and then coupling said first driving shaft with said driving cylinder to move said second basket alone from said rest position down to said second position, means actuatable by said third shift key for unlocking said third basket, engaging said lever means of said first driving shaft with said third basket and then coupling said first driving shaft with said driving cylinder to move said third basket together with said first and second baskets from said rest position down to said second position, means actuable by said fourth shift key for unlocking said third basket, engaging said lever means of said second driving shaft with said third basket and then coupling said first driving shaft with said driving cylinder to lift said third basket together with said first and second baskets from said rest position to said third position, and means for returning said baskets to their rest positions when said shift keys are released.

3. A syllabic keyboard controlled device comprising a carriage cylinder, a plurality of type bars arranged in groups each of which corresponds to a distinct printing point, a plurality of sectors each of which pivotally supports at one end the type bars of a respective group, said type bars having heads at their other ends, each of said type bars having characters arranged on its head at different levels or cases, means for mounting certain of said sectors for movement independently of others for case shifting to print characters of different case, thin guide sheets fixed to each of said sectors at lateral extremities thereof, cushions fixed to and supported by said thin sheets in position to support heads of the type bars of the respective group of type bars when in rest position, there being two of said thin sheets between adjacent type bar groups the supporting sectors of which are independently movable relative to one another for case shifting and one of said thin sheets between adjacent groups of type bars which are movable together for case shifting, said thin sheets being continuous from said cushions up to near said carriage cylinder and being situated between the paths of movement of type bars belonging to adjacent type bar groups to constitute guides for said type bars in their printing movement from said cushions to said carriage cylinder.

* * * * *